US009656376B2

(12) United States Patent
Maltais et al.

(10) Patent No.: US 9,656,376 B2
(45) Date of Patent: May 23, 2017

(54) STAPLES FEEDER ASSEMBLY WITH CONCEALED SLIDER FOR PNEUMATIC FASTENER MAGAZINE

(71) Applicant: Laboratoire Primatech Inc., Quebec, Quebec (CA)

(72) Inventors: Jacques Maltais, Beauport (CA); Marc Dion, St-Augustin-de-Desmaures (CA); David Lavoie, Quebec (CA)

(73) Assignee: LABORATOIRE PRIMATECH INC., Quebec (CA)

( * ) Notice: Subject to any disclaimer, the term of this patent is extended or adjusted under 35 U.S.C. 154(b) by 492 days.

(21) Appl. No.: 14/489,514

(22) Filed: Sep. 18, 2014

(65) Prior Publication Data

US 2015/0076204 A1 Mar. 19, 2015

Related U.S. Application Data

(60) Provisional application No. 61/879,328, filed on Sep. 18, 2013.

(51) Int. Cl.

| | |
|---|---|
| ***B25C 5/16*** | (2006.01) |
| ***B25C 1/00*** | (2006.01) |
| ***B25C 5/10*** | (2006.01) |
| ***B25C 5/13*** | (2006.01) |

(52) U.S. Cl.
CPC ..... *B25C 5/1617* (2013.01); *B25C 5/13* (2013.01)

(58) Field of Classification Search
CPC B25C 1/008; B25C 5/025; B25C 5/10; B25C 5/1696; B25C 5/1665; B25C 1/00; B25C 5/16; B25C 1/001; B25C 1/047; B25C 5/1675; B25C 5/1617; B25C 5/1606
See application file for complete search history.

(56) References Cited

U.S. PATENT DOCUMENTS

| | | | |
|---|---|---|---|
| D323,272 | S | 1/1992 | Dion |
| 5,322,189 | A | 6/1994 | Oda |
| D377,301 | S | 1/1997 | Dion |
| 6,161,746 | A | 12/2000 | Wey |

(Continued)

FOREIGN PATENT DOCUMENTS

EP 0641628 A1 3/1995

*Primary Examiner* — Andrew M Tecco
*Assistant Examiner* — Praachi M Pathak
(74) *Attorney, Agent, or Firm* — Fraser Clemens Martin & Miller LLC; James D. Miller

(57) ABSTRACT

The present invention consists of the complete integration of a self arming controlled action pneumatic fastener magazine slider (pusher and feeder) within the two legs of a stack of U-shape staples on a magazine support rail, thanks to the interplay of two pairs of releasably interlocking sensor and keys fastener pusher elements. In one embodiment of the invention, the slider system is self-arming and fits within an elbowed magazine for receiving fasteners, but works along the straight portion of the magazine. This slider system will accommodate elongated magazine holding a larger number of fasteners. The slider system will decrease the time required for fastener reloading by simplifying operations and enabling a greater flexibility for the operator. A fastener retention device may be provide to the fastener pusher, defining an operative mode active with a large storage load of fasteners into the magazine, and a inoperative mode triggered when the load of magazine feeders decreases below a threshold value.

15 Claims, 24 Drawing Sheets

(56) References Cited

U.S. PATENT DOCUMENTS

| | | | |
|---|---|---|---|
| 6,688,510 | B2 | 2/2004 | Amada |
| 7,048,169 | B2 | 5/2006 | Sun |
| 8,292,144 | B2 | 10/2012 | Maltais et al. |
| 8,777,079 | B2 | 7/2014 | Po et al. |
| 2010/0127035 | A1 | 5/2010 | Wu |
| 2012/0187177 | A1 | 7/2012 | Myburgh |
| 2013/0320066 | A1 | 12/2013 | Gregory et al. |

STAPLES FEEDER ASSEMBLY WITH CONCEALED SLIDER FOR PNEUMATIC FASTENER MAGAZINE

CROSS-REFERENCE DATA

The present application claims Paris convention priority based upon U.S. provisional patent application No. U.S. 61/879,328 filed Sep. 18, 2013.

FIELD OF THE INVENTION

The present invention addresses the issue of two step loading of staples in pneumatic nailers, as well as increasing fastener loading capacity in the magazines of such nailers.

BACKGROUND OF THE INVENTION

Pneumatic, electrical or manual tools for driving fasteners usually incorporate a magazine for loading interconnected (e.g. with glue, welding, ribbon . . . ) fasteners. The last (trailing end) fastener in the magazine will feed the tool at the level of the striking rod, to provide the following fastener to be driven. The magazine will extend from this point to gather a given number of fasteners. Orientation of such extension can be rearward, lateral, or other direction, at right angle or with a certain angular value. The stack of fasteners is configured complementarily to the size and shape of the magazine.

In most known fasteners, magazines require that prior to fastener loading, the slider must be pulled back to enable the fasteners to be fitted within the magazine fastener support rail, since the fasteners cannot extend therethrough. Afterwards, a spring mechanism must be activated to push the fasteners forward. Fasteners can be loaded without prior slider pulling back; however, the slider must then be brought back to its maximum limit position for declutching the system, which will then allow the fasteners to move therethrough, so that the slider be released rearwardly of the fasteners.

With respect to nailer magazines for nails, or other single leg fasteners, loading is done in a two step process:

1. loading fresh fasteners; and
2. pulling and then releasing the pusher so that the latter engage behind the fasteners.

On the other hand, with U-shaped staples magazines, loading is done in a three step process:

1. pulling back the pusher to free the loading rail;
2. loading fresh fasteners; and
3. releasing the pusher.

In particular, improvements could be brought to the pneumatic fasteners disclosed in applicant's U.S. Pat. No. 8,292,144, by incorporating an improved fastener feeder assembly to their magazine, as disclosed hereinbelow. Such fasteners are of the type for driving L- or T-shape fasteners or other one leg fasteners into hard wood floors, but could also in other cases be applicable with straight nails. Such improvements are also directed to correct deficiencies from use of fasteners magazine having a securing fasteners ribbon coil.

Although the fastener elbowed magazine disclosed in FIG. 1 of applicant's U.S. Pat. No. 8,292,144, will operate well under gravity forces and without slider, it may become necessary in some cases to use a slider to push the fasteners toward the ejection channel and this, in particular, in sub-optimal fasteners jam prone conditions. All sliders load the fasteners by bearing at the trailing end portion thereof and applying a retention force with a spring member. As a consequence, the magazine must be longer than the total length of all coextensive fasteners strips. Another issue is that the current sliders will not lend themselves easily to a modification of orientation. Moreover, simply extending the length of a magazine to accommodate more fasteners will have a number of drawbacks, including:

1. its bulk will bring the fastener tool farther away from the working area;
2. the center of gravity of the fastener tool will shift, thus compromising stability thereof;
3. because of the fastener overall design, once the magazine exceeds a given length, ergonomic issues appear when handling the handle, whereby loads will be applied to the user's wrist which will become constantly twisted for proper positioning of the fasteners, which will bring muscular fatigue.

It will be understood that with prior art fasteners, a number of wooden planks close to the upright wall will become out of reach from the fastener.

SUMMARY OF THE INVENTION

The invention relates to a self-arming staples feeder system in a fastener driving device for feeding U-shape staples from a fastener support rail formed in a magazine to a fastener drive track formed in a drive guide for reciprocating movement of a driver and connected to a forward portion of the fastener guide track, the U-shape staples defining two side legs and a base leg, said feeder system comprising: a slider member operable by an operator and slidably movable in a facing guide tracks slider channel in a longitudinal direction of the fastener support rail; biasing means for biasing said slider member in the forward direction of the fastener support rail slider channel; a pusher member movably mounted in said slider channel in the longitudinal direction of the fastener support rail and defining a pair of opposite sensors, each of said sensors having opposite first and second end portions, a pair of spaced jaws formed at said sensors first end portions and sized and shaped for abutting against the staples side legs respectively at a trailing end of a stack of staples on said support rail, said jaws defining a gap therebetween, and free standing hinge means provided at said sensors second end portions for tilting said sensors relative to one another responsive to staples travel wherein said jaws are movable relative to one another between an open position in register with the staples two side legs, and a retracted position clearing the trailing end of the stack of staples wherein the pusher member is sized and shaped to freely engage within said channel member and between the two side legs of the U-shape staples carried by the support rail in said jaws open position in concealed fashion; and interlocking means provided between said slider member and said pusher member for permitting movement of said pusher member concurrently with said slider member within said channel member and for moving said pusher member in such a manner that said jaws move from said open position to said retracted position according to movement of said slider member in a rearward direction of the fastener support rail.

In one embodiment, said hinge means comprises a pair of keys, for slidingly engaging said slider channel and edgewisely freely mounted to said sensors intermediate said first and second end portions thereof, each of said keys having a transverse ear and each of said sensors second end portions having a transverse cavity of complementary shape to that of a corresponding key ear, said keys ears releasably engaging with corresponding said sensors cavities, each said sensor being planar, wherein an enclosure is formed between said planar sensors and circumscribed by said keys.

In one embodiment, said interlocking means comprises a tenon member, integrally carried by said slider member, a mortise section being formed within said sensors and keys enclosure including a second mouth at said sensors second end portions and of shape complementary to that of said tenon member, said second mouth releasably engaged by said tenon member.

Each of said pusher member keys may further includes a guide finger, opposite corresponding said cavities, the two guide fingers extending into said sensors and keys enclosure adjacent said jaws thereof.

The invention also relates to a combination of a pneumatic nailer two in one magazine and a nails and two step self-arming loading staples feeder system in a fastener driving device for feeding nails and U-shape staples from a fastener support rail formed in said magazine to a fastener drive track formed in a drive guide for reciprocating movement of a driver and connected to a forward portion of the fastener guide track, the U-shape staples defining two side legs and a base leg, said feeder system comprising a slider member operable by an operator and slidably movably mounted in a facing guide tracks slider channel made in a longitudinal direction of the fastener support rail; biasing means for biasing said slider member in the forward direction of the fastener support rail; a pusher member movably monted within said slider channel in the longitudinal direction of the fastener support rail and defining a pair of opposite planar sensors, each of said sensors having opposite first and second end portions, a pair of spaced jaws formed at said sensors first end portions and sized and shaped for abutting against the staples two side legs respectively at a trailing end of a stack of staples on said support rail, said jaws defining a gap therebetween, and free standing hinge means provided at said sensors second end portions for tilting said sensors relative to one another wherein said jaws are movable relative to one another between an open position in register with the two side legs of the staples, and a retracted position clearing the trailing end of the stack of staples wherein the pusher member is sized and shaped to freely engage within said slider channel between the two side legs of the U-shape staples carried by the support rail in said jaws open position and be concealed by same; and interlocking means provided between said slider member and said pusher member for permitting movement of said pusher member concurrently with said slider member and for moving said pusher member in such a manner that said jaws move from said open position to said retracted position according to movement of said slider member in a rearward direction of the fastener support rail.

In one embodiment, there is provided a staples jamming mitigating means, substantially reducing the likelihood of staples jamming inside the magazine fastener support rail when the number of staples remaining said fastener support rail is reduced to only a few. Said staples jamming mitigating means could consist of a toggle lever means cooperating with said biasing means and responsive to travel of the staples in preventing said slider member to extend beyond a threshold area of said fastener support rail closely spacedly proximate said fastener support rail. Alternately, said staples jamming mitigating means could consist of a sensor seat, projecting outwardly from the plane of one of said planar sensor and providing transverse abutment surface in the way of travel of fasteners and preventing said fasteners to extend beyond a threshold area of said fastener support rail closely spacedly proximate said fastener support rail.

The invention also relates to the combination of a pneumatic nailer magazine and a controlled action two step self-arming loading staples feeder system in a fastener driving device for feeding nails and U-shape staples from a fastener support rail formed in said magazine to a fastener drive track formed in a drive guide for reciprocating movement of a driver and connected to a forward portion of the fastener guide track, the U-shape staples defining two side legs and a base leg, said feeder system comprising : a slider member operable by an operator and slidably movably mounted in a facing guide tracks slider channel made in the longitudinal direction of the fastener support rail slider channel; biasing means biasing said slider member in the forward direction of the fastener support rail; a pusher member movably mounted in said slider channel in the longitudinal direction of the fastener support rail and defining a pair of opposite planar sensors, each of said sensors having opposite first and second end portions, a pair of spaced jaws formed at said sensors first end portions and sized and shaped for abutting against the staples two side legs respectively at a trailing end of a stack of staples on said support rail, said jaws defining a gap therebetween, and free standing hinge means provided at said sensors second end portions for tilting said sensors relative to one another responsive to staples travel wherein said jaws are movable relative to one another between an open position in register with the two side legs of the staples, and a retracted position clearing the trailing end of the stack of staples wherein the pusher member is sized and shaped to freely engage within said slider channel and between the two side legs of the U-shape staples carried by the support rail in said jaws open position and be concealed by same; interlocking means provided between said slider member and said pusher member for permitting movement of said pusher member concurrently with said slider member within said slider channel and for moving said pusher member in such a manner that said jaws move from said open position to said retracted position according to movement of said slider member in a rearward direction of the fastener support rail; said nails and staples movable under gravity forces through said fastener support rail from a fastener intake means thereof to a fastener discharge means thereof opposite said fastener intake means; and a pusher means retention means, said retention means having an operative mode, active with a large storage load of fasteners into said channel member, and an inoperative mode, triggered when said load of fasteners in said channel member decreases below a threshold value.

In one embodiment, said fastener pusher member includes a carriage slidably carried into said channel with said carriage including a notch and said retention means including an elongated rigid lock tab endwisely pivotally mounted at an intermediate first pivot mount to said channel at said fastener intake means, wherein one and another tab end portions are defined on opposite sides of said first pivot mount, said another tab end portion including an intermediate transversely projecting ear releasably engaged into said notch in said fastener pusher means operative mode; and said ear disengaged from said notch in said fastener pusher means inoperative mode, said inoperative mode being induced by fastener depletion-based tilt release of said another tab end portion about said first pivot mount.

In another embodiment, said fastener pusher member includes a carriage slidably carried into said channel and having a transverse leg, and said retention means includes an ear integrally projecting from opposite side walls defined by said channel therewithin, said ear releasably abutting against said transverse leg in said operative mode of said retention means, and said ear disengaging said carriage transverse leg in said inoperative mode thereof, said inoperative mode being induced by fastener depletion-based release of said transverse leg from said ear.

In one embodiment, said pneumatic nailer magazine is a two in one magazine, and wherein said feeder system is a controlled action nails and two step self-arming loading staples feeder system.

DETAILED DESCRIPTION OF THE EMBODIMENTS OF THE INVENTION

The present invention consists of the complete integration of a self-arming pneumatic fastener magazine slider (pusher and feeder) within the two legs of a stack of U-shape staples, thanks to the interplay of two pairs of releasably interlocking sensor and keys pusher elements. In one embodiment of the invention, the self arming slider system fits within an elbowed magazine for receiving fasteners, but works along the straight portion of the magazine. This slider system will accommodate longer magazine holding a larger number of fasteners compared to the prior art. The slider system will decrease the time required for fastener reloading by simplifying operations and enabling a greater flexibility for the user. For example, the external size of the slider sensors may be $\frac{3}{8}^{th}$ of an inch, when the internal channel formed between the two side legs of the U-shape staples by the fasteners strip would then be slightly larger at half an inch.

Accordingly, the main feature of the present invention is a pusher member maintained between the two U-shape staples side legs, in the general context of rearward loading without requiring prior magazine opening and with gravity feed of fasteners. In one embodiment, there is provided a slider retention member with double trigger. In one embodiment, the fastener magazine may be straight, but with a change of direction.

Figure 1:
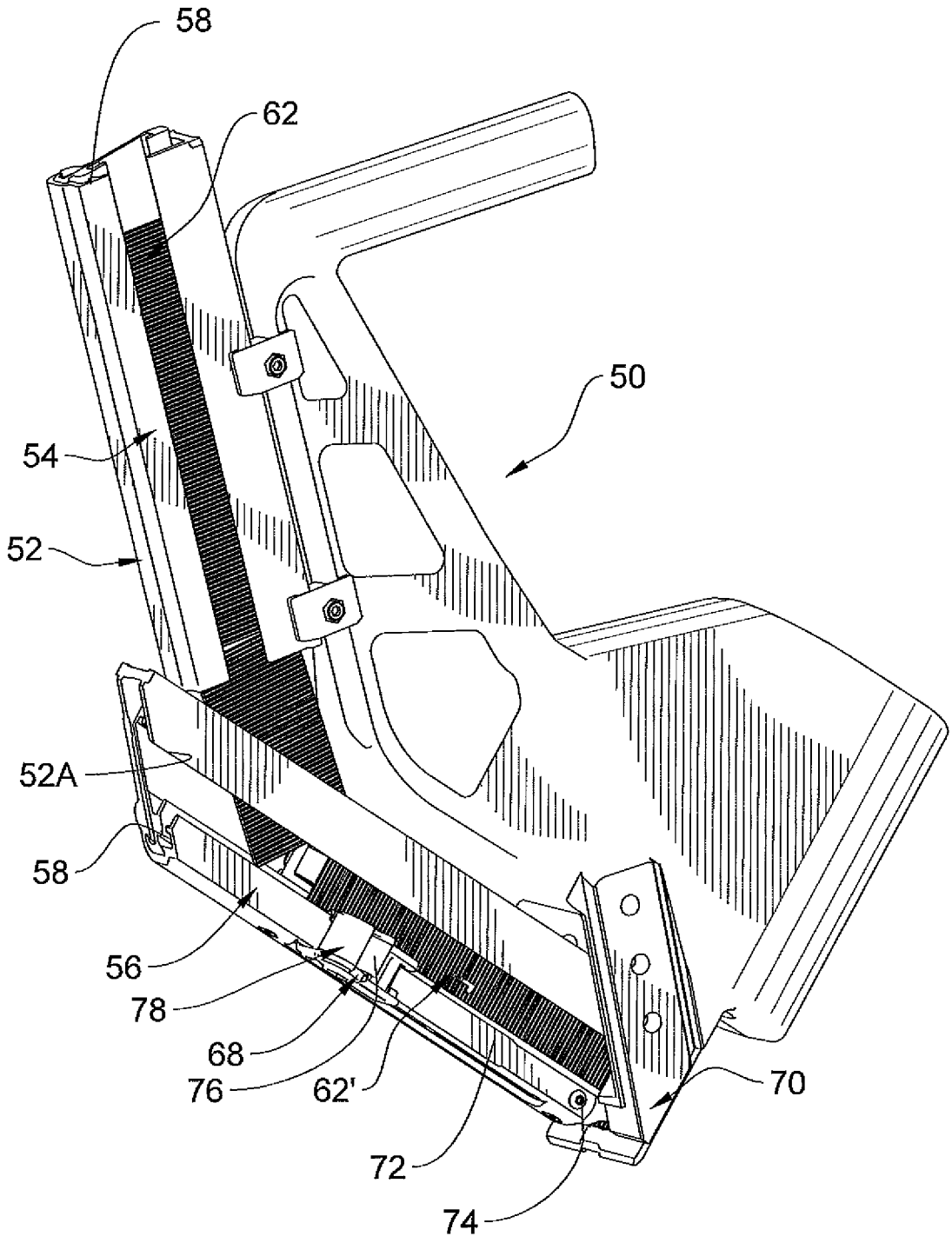
FIG. 1 is a schematic perspective view of a pneumatic nailer with two coextensive but angularly disposed fasteners magazines each carrying a full stack of staples along two different longitudinal axes, the lower magazine assembly being provided with one embodiment of staples feeder assembly of the invention.
Figure 2:
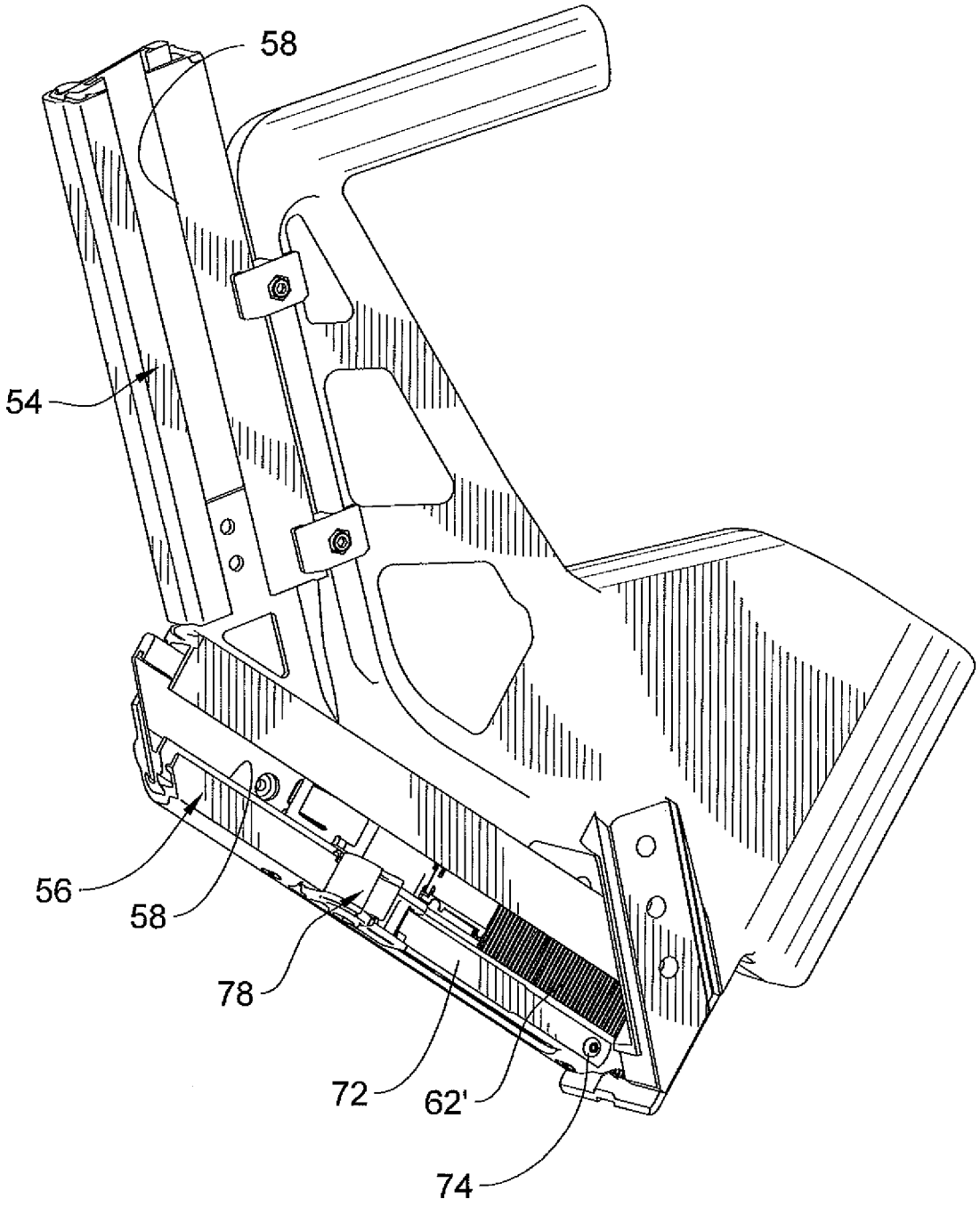
FIG. 2 is a view similar to FIG. 1, but with the top magazine emptied of fasteners and the lower staples magazines carrying only a partial stack of staples, and with the feeder assembly in operatively engaged condition.
Figure 4:
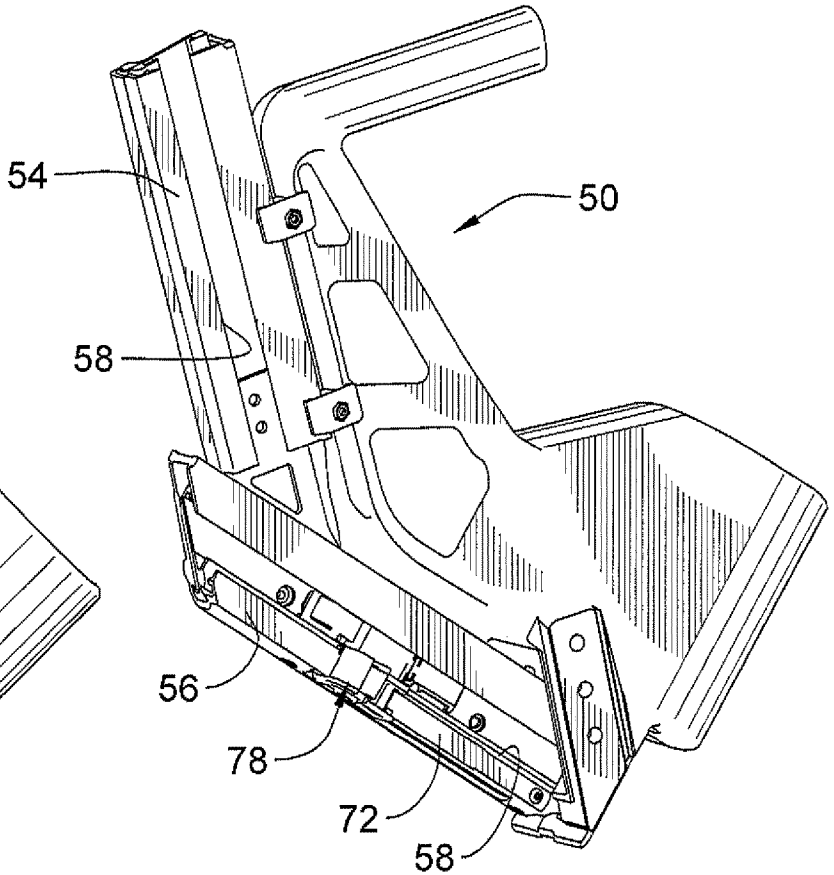
FIGS. 3 and 4 are two different perspective views of the elements of FIG. 1 but at a smaller scale and with both magazines emptied of staples.
Figure 3:
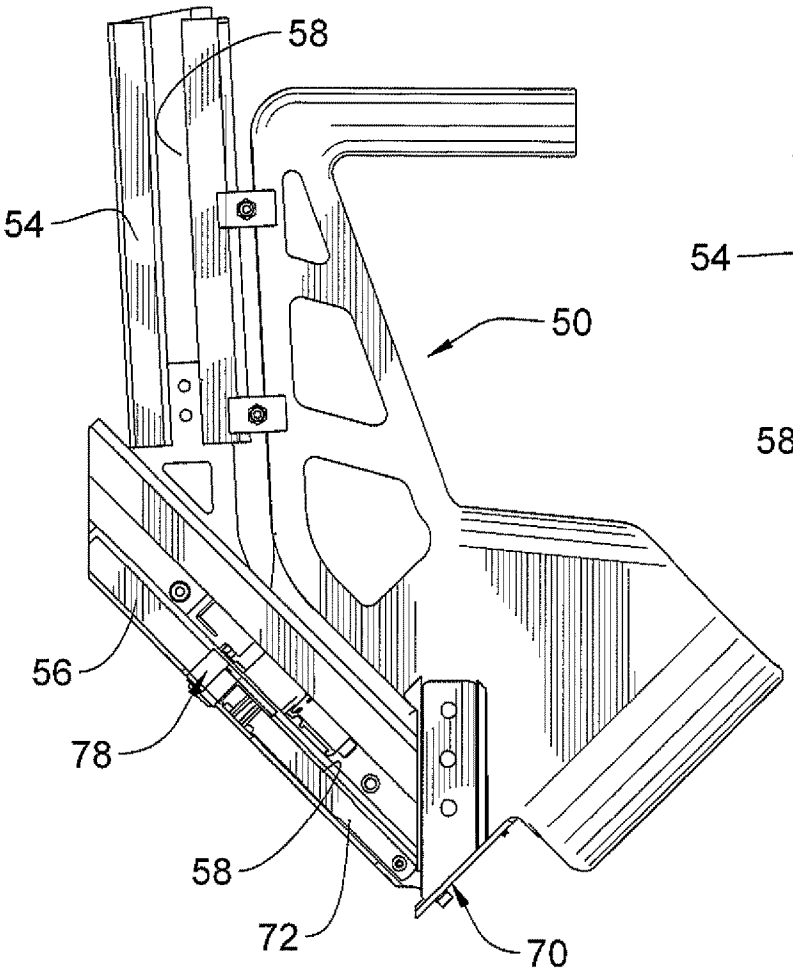
Figure 5:
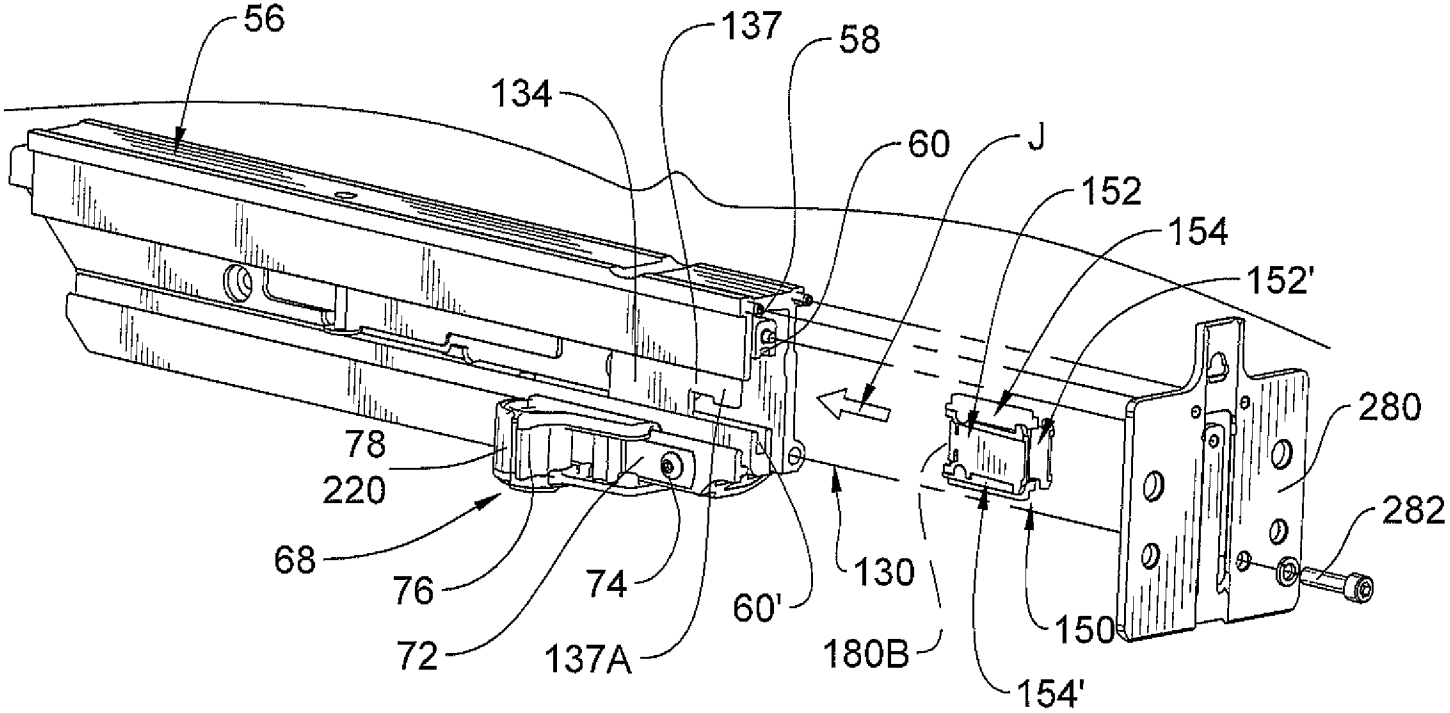
FIG. 5 is an enlarged partly exploded view of one embodiment of the lower magazine and feeder assembly.
Figure 36:
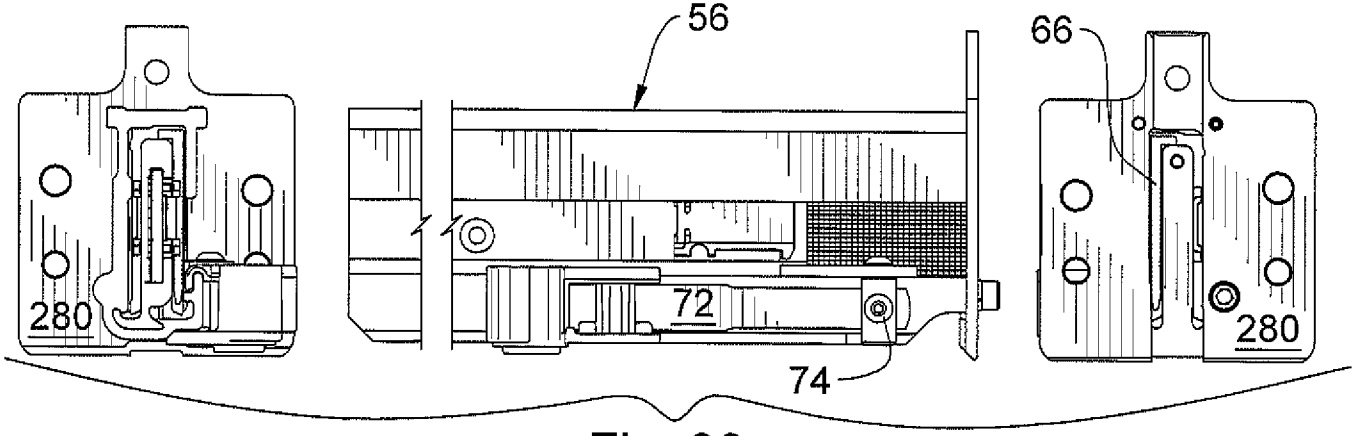
FIGS. 35 and 36 are exploded views of the elements of FIG. 21, showing stacks of U-shape staples and nails respectively being loaded into a 2-in-1 fastener magazine.

FIGS. 1 to 4 show a pneumatic nailer 50 with an integral elbowed fastener magazine 52 defining an upper section 54 and a lower section 56 at an angle relative to upper section 54. Each magazine 54, 56, defines a fasteners support rail 58 for support and slide-through passage of fasteners 52. Upper and lower slider guide tracks 60 are formed on the interior facing sides of support rail 58, for slide through passage in a thus formed slider channel of a fastener biasing slider 134 (FIG. 5). Fasteners 62 may be e.g. U-shape staples, as illustrated in FIGS. 23-24, 25A, 26, 30-31, 33-35 of the drawings, or single leg nails, as illustrated in FIGS. 16 and 36. Fastener support rails 58 of magazine sections 54, 56, endwisely open into one another at elbow section 52A between magazines sections 54 and 56. In FIG. 1, each fastener support rail 58 of magazines 54, 56, carries a stack of fasteners 62, 62'. A recoil system 68 is mounted to the lower magazine 56 for biasing the lower stack of fasteners 64 toward the bottom fastener strike ejection channel 70. Recoil system 68 defines an elongated band 72, anchored at its bottom end by rivet 74 to the lower section of magazine 56 close to fastener ejection channel 70, and a casing 76 slidably mounted externally of lower magazine 56. Casing 76 includes an internal spring loaded spool, and a transverse slider support structure 78 (FIG. 15) for engagement with the fasteners inside the magazine fastener support rail 58.

FIG. 1 discloses an elbowed magazine mounted onto a pneumatic fastener. The change of direction of the magazine is clearly seen as being an angular corner, but this could alternately be a radius of curvature.

In FIG. 1, the magazine is manufactured from an aluminum extrusion assembly. The cross-section is thus the same for all the length thereof, except at the machined sections. It is noted that one must open the top of the magazine at the elbowed section (or curvature), at an elbowed mouth, to allow the fasteners strips to clear this section and continue their way toward the ejection channel. This figure also shows the aperture which allows the positioning of the slider within the fasteners' strip.

Figure 15:
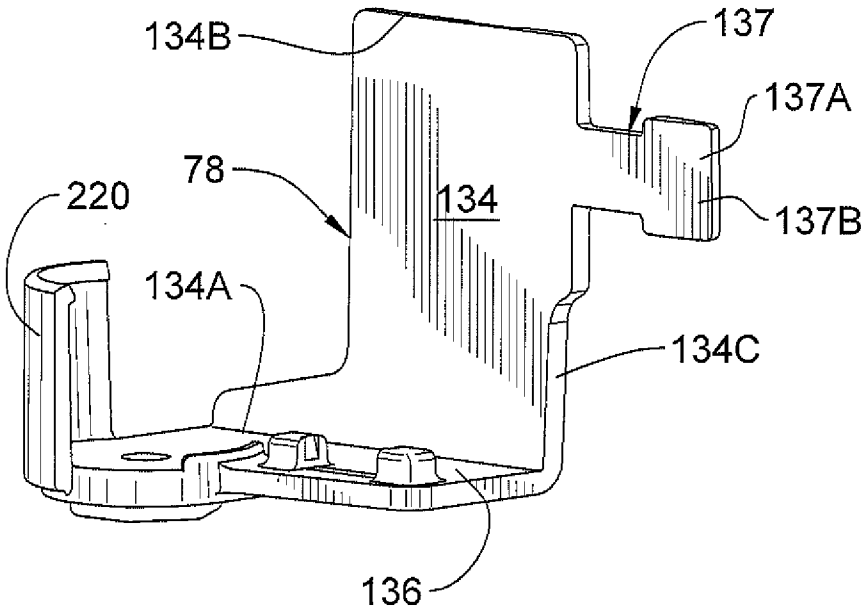
FIG. 15, on the fifth sheet of drawings, is an enlarged perspective view of the tenon element and associated support structure from the feeder assembly of FIG. 5.
Figure 8:
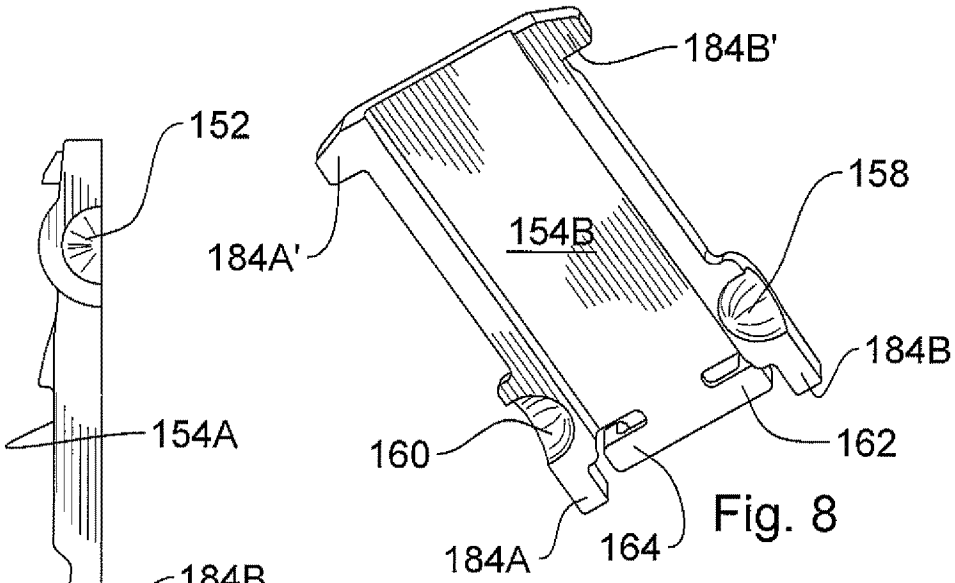
FIGS. 7 to 9 are a top plan view, a bottom perspective view and a top perspective view respectively of either one of the pair of sensors from the FIG. 6.
Figure 9:
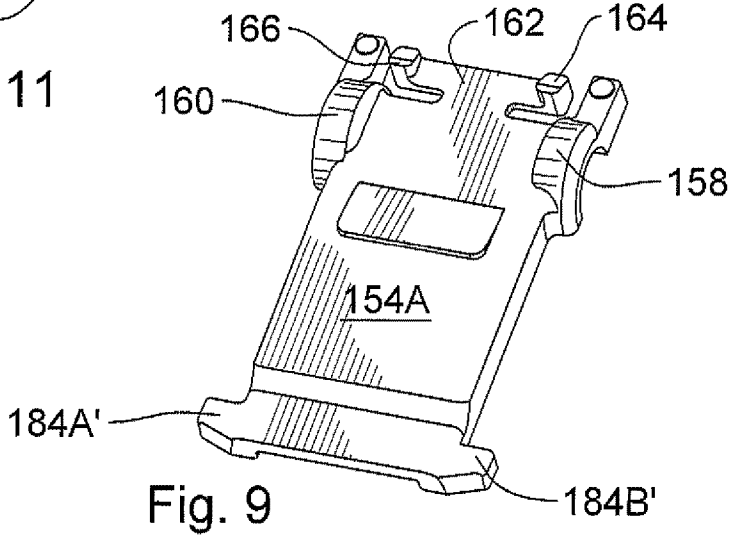
Figure 11:
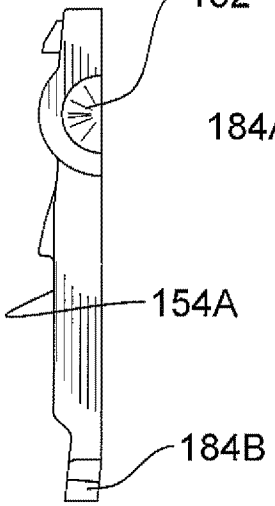
FIGS. 10 and 11 are end and lateral edge views of each of the keys of FIG. 6.
Figure 7:
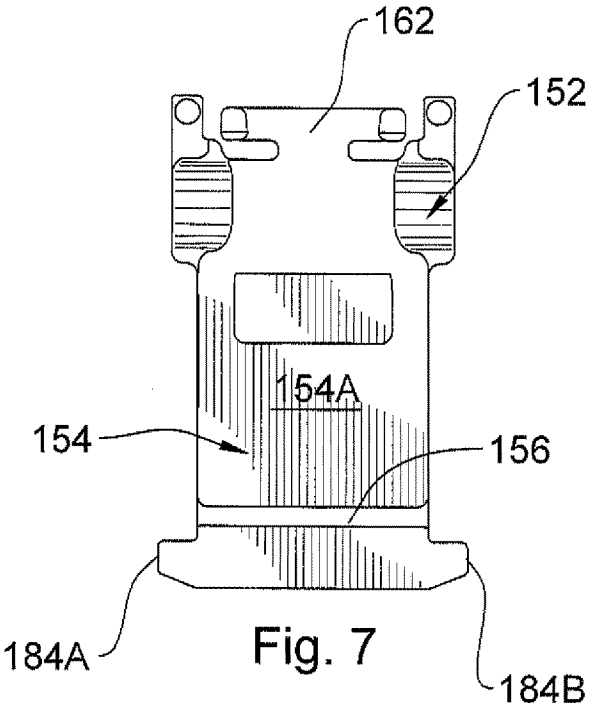
Figure 10:
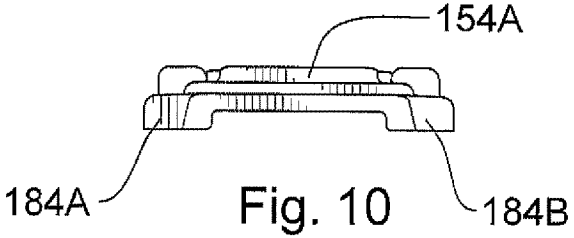
Figure 16:
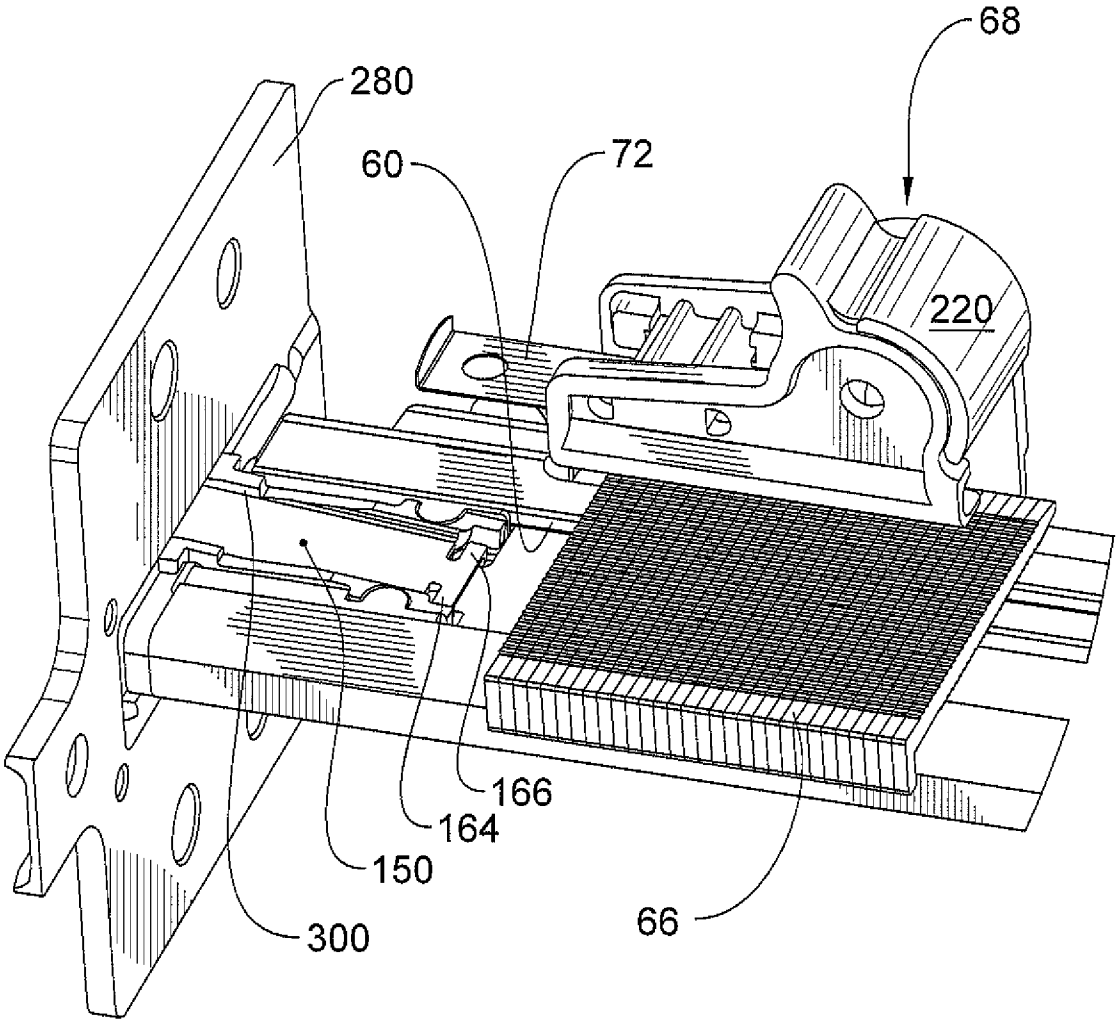
FIG. 16 shows an enlarged perspective view of an end portion of the magazine of FIG. 1, together with a stack of one leg nails, and further showing an alternate embodiment of feeder assembly, where the sensors are provided with a stopper seat to prevent accidental nail jamming during magazine nail loading.
Figure 25:
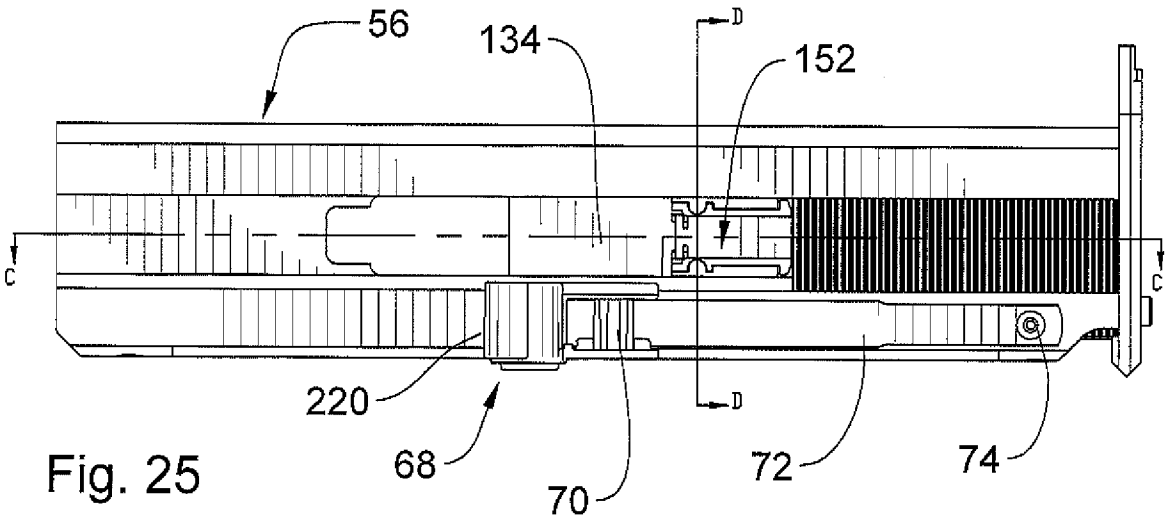
FIG. 25 is a plan view of the elements of FIG. 21, showing the staples feeder assembly at one position, where the pushers are engaged behind the U-shape staples and push the latter.
Figure 25A:
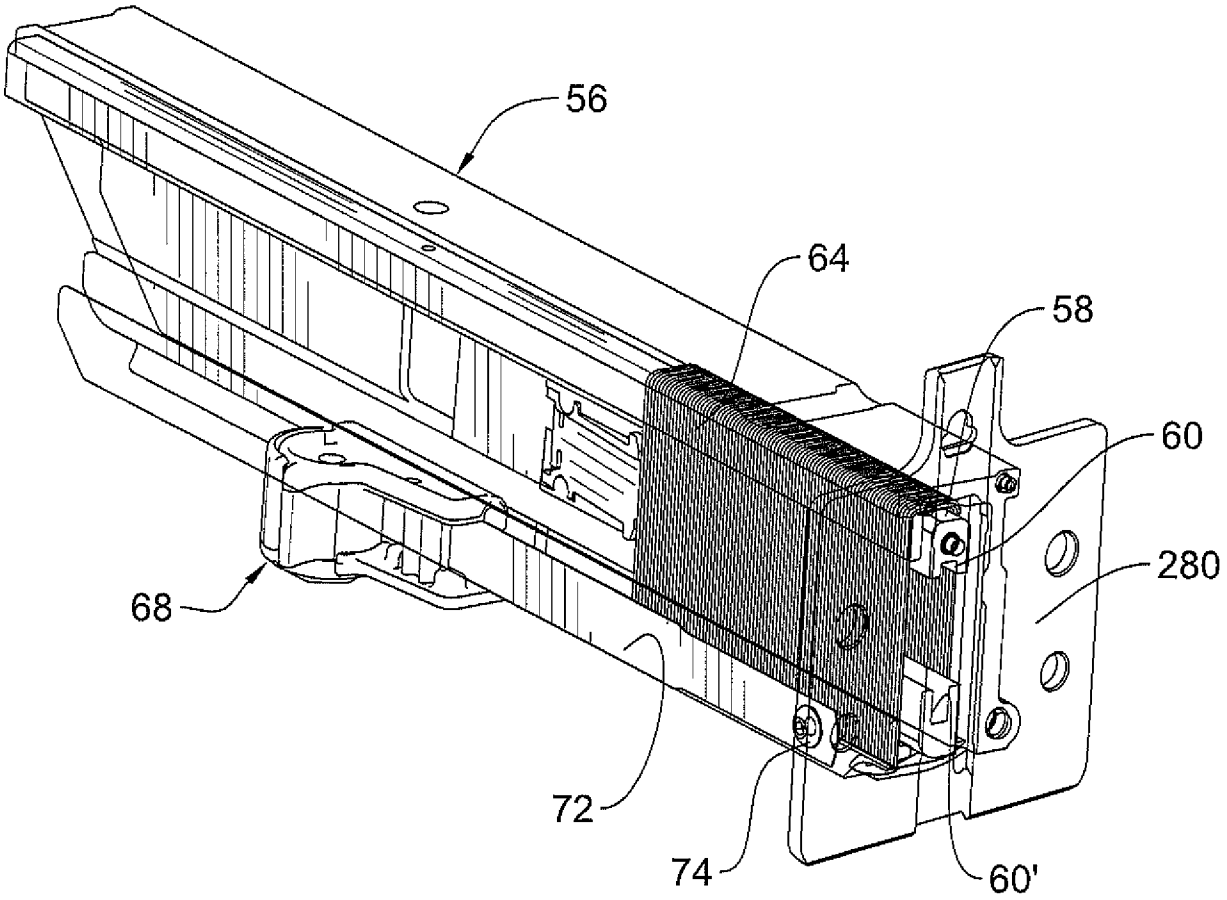
FIG. 25A is a partly broken perspective view in dotted lines of the magazine and fastener feeder system of FIG. 25, clearly showing in full lines a stack of U-shape staples.
Figure 27:
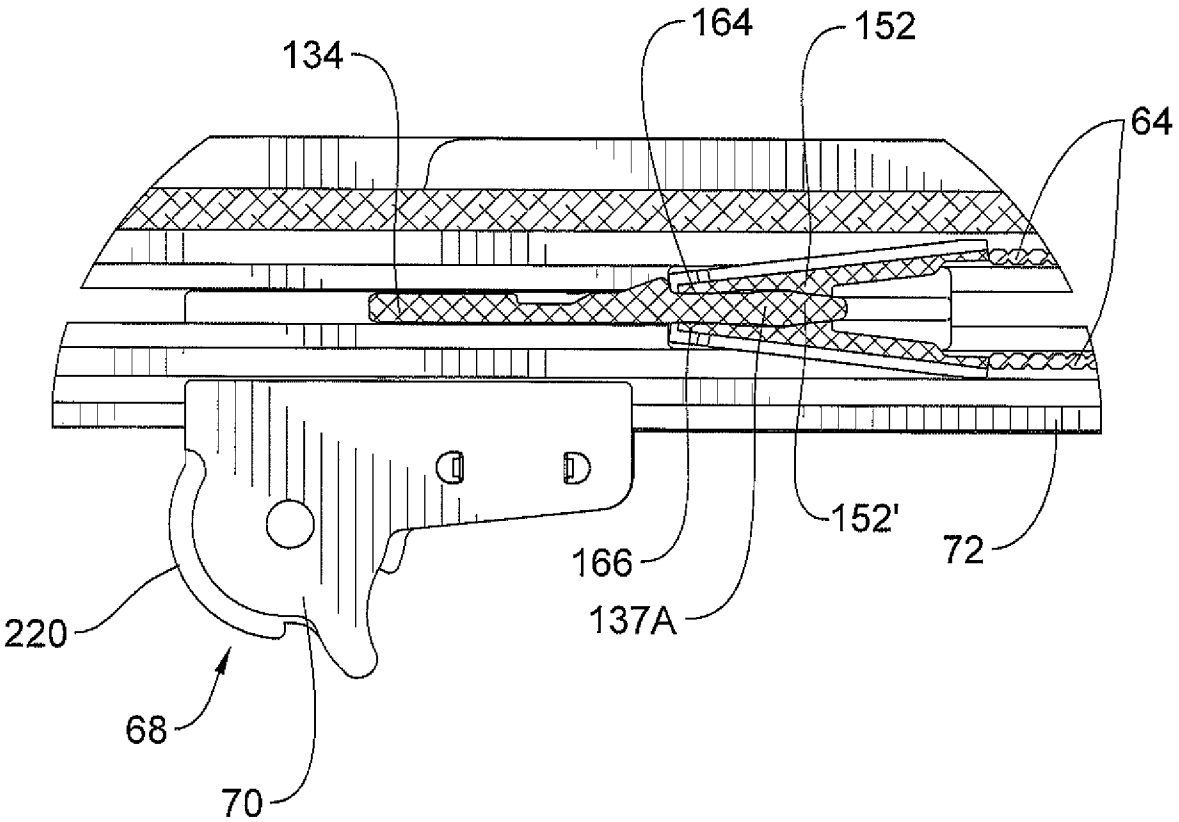
FIG. 27 is an enlarged view of the area circumscribed within circle G of FIG. 26.
Figure 28:
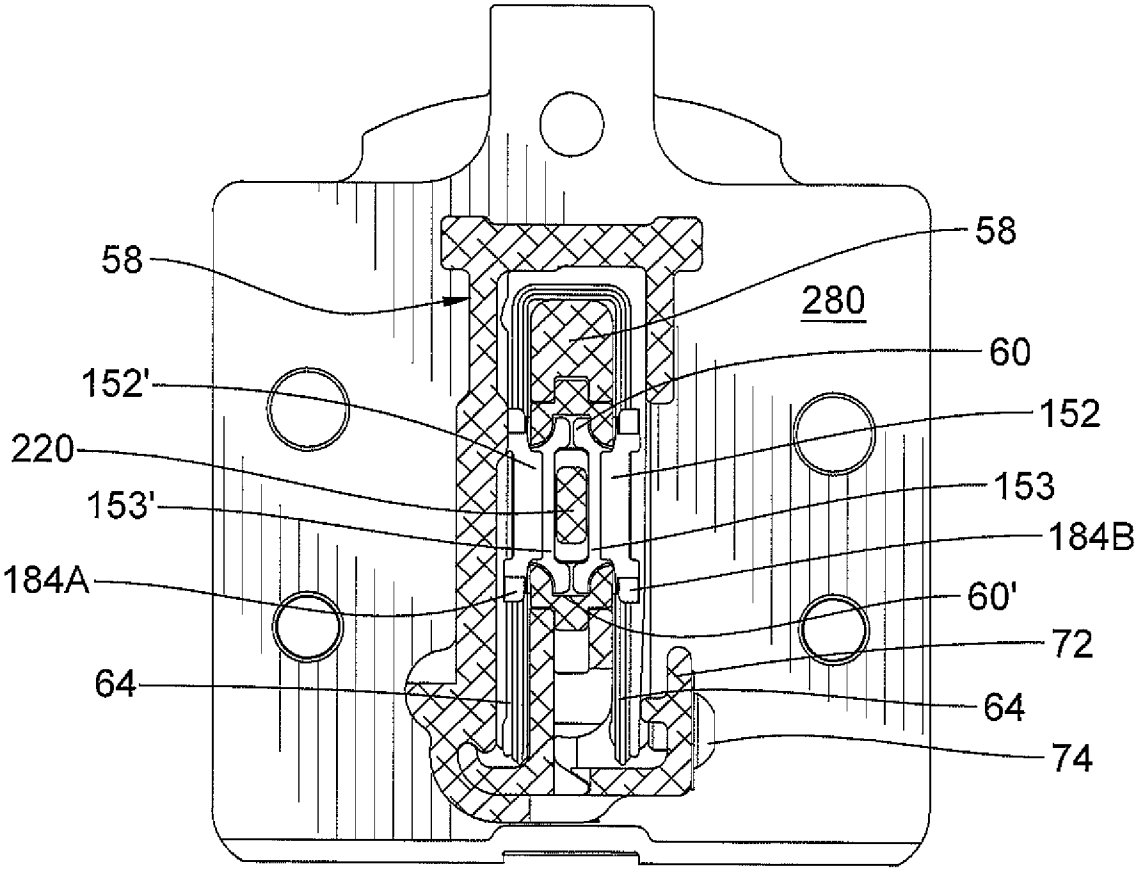
FIG. 28 is an enlarged cross-sectional view taken along line D-D of FIG. 25.
Figure 30:
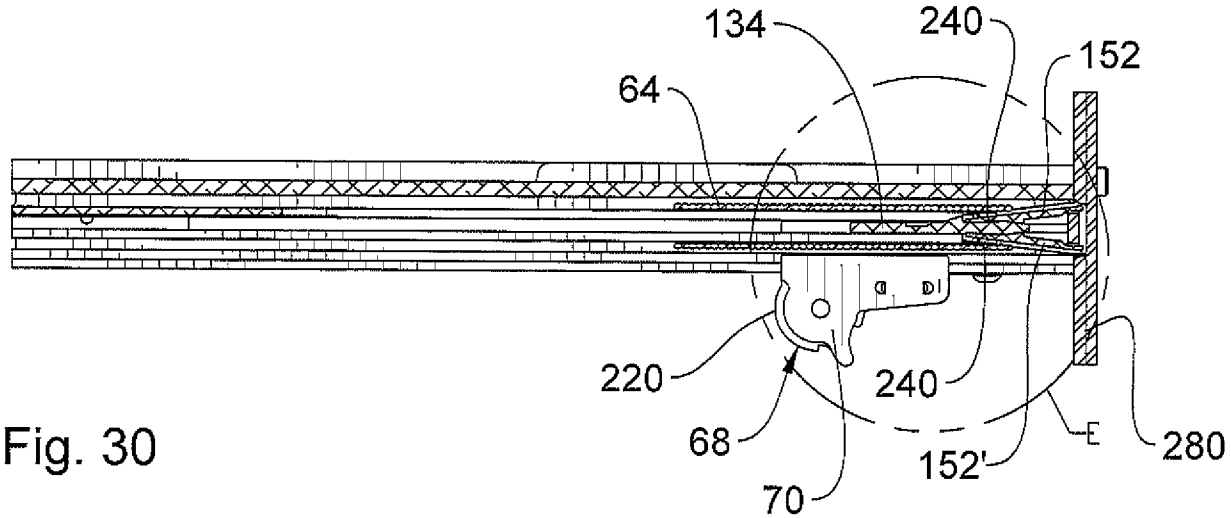
FIG. 30 is a longitudinal sectional view taken along line A-A of FIG. 29.
Figure 29:
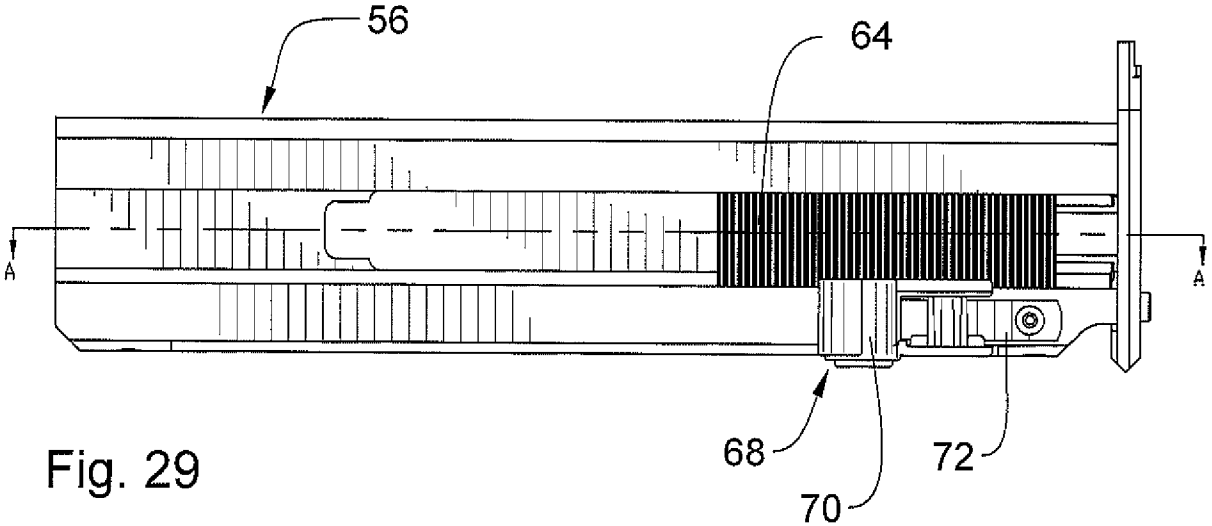
FIG. 29 is a view similar to FIG. 25 but showing the staples feeder assembly at another condition, where the staples have become depleted and have now been reloaded in the magazine.
Figure 31:
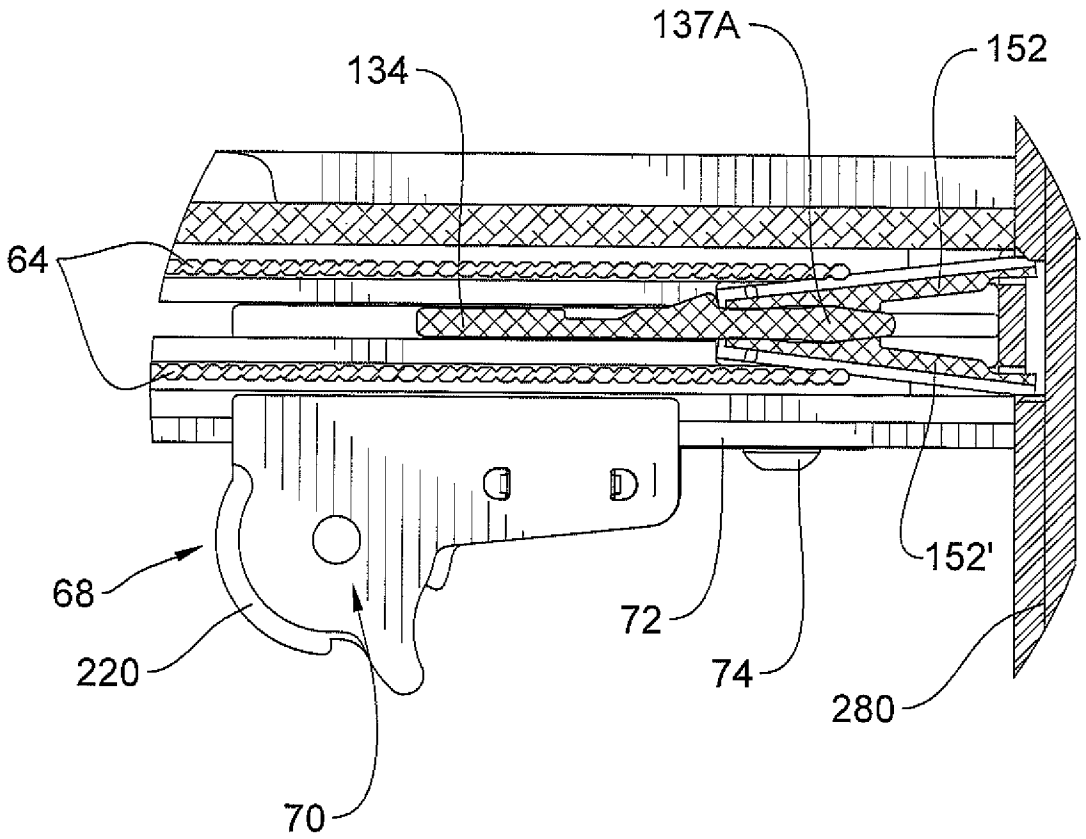
FIG. 31 is an enlarged view of the area circumscribed within circle E of FIG. 30.
Figure 33:
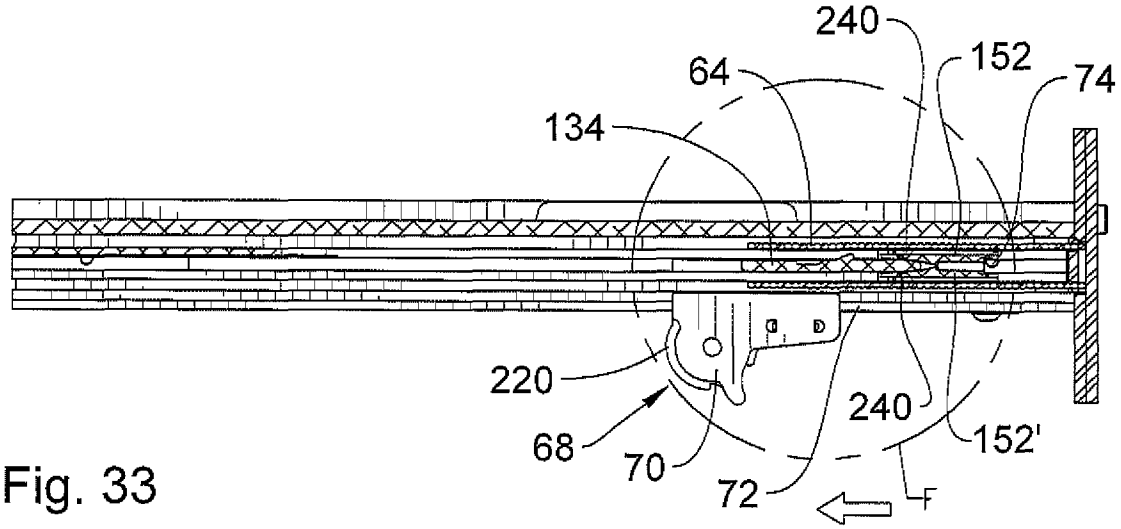
FIG. 33 is a longitudinal sectional view taken along line B-B of FIG. 32.
Figure 32:
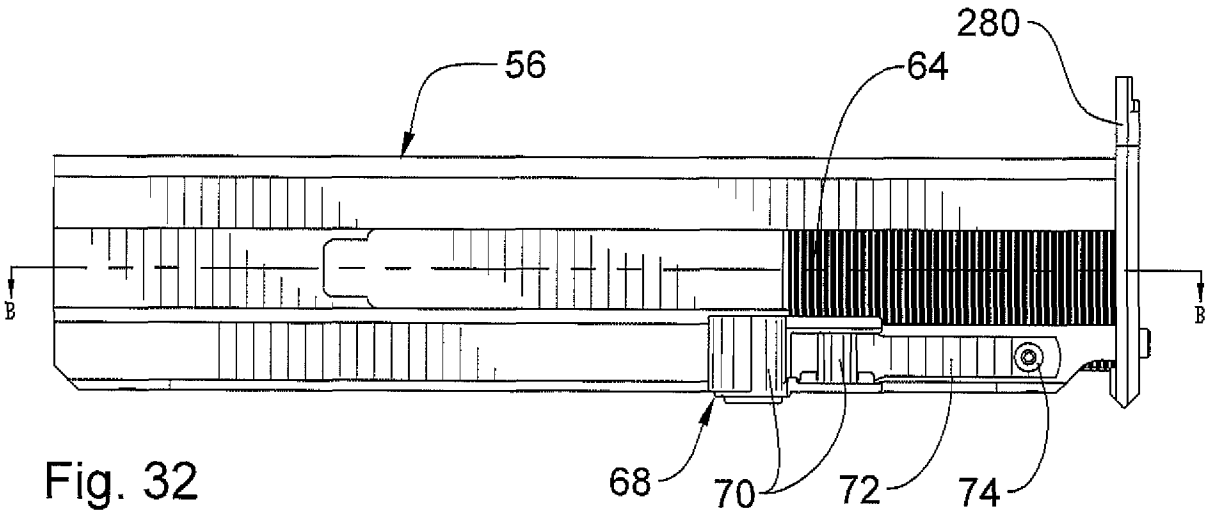
FIG. 32 is a view similar to FIG. 25, but showing the staples feeder assembly at a third position.
Figure 34:
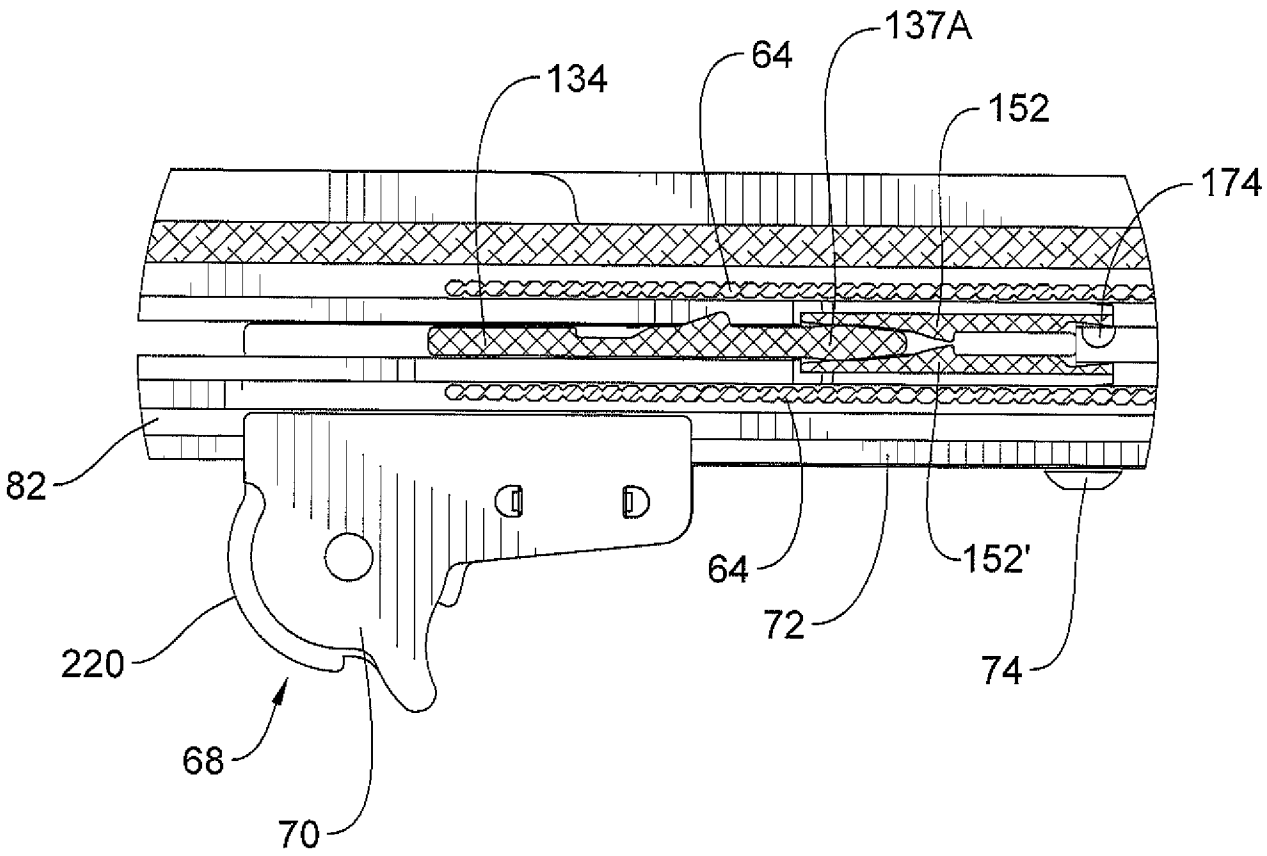
FIG. 34 is an enlarged view of the area circumscribed within circle F of FIG. 33.

FIGS. 5 to 15 show the various components of the fastener feeder system 130. Slider support structure 78 defines a generally quadrangular slider plate 134, adapted to slidingly fit edgewisely inside magazine slider guide track 60, 60', about a bottom edge thereof 134A and a top edge thereof 134B. As best illustrated in FIG. 25A, the channel between tracks 60, 60', is smaller than and located within the area circumscribed by the U-shape staples 64 supported by fasteners support rail 58. A flange 136 transversely projects from bottom edge 134A and a tenon member 137 transversely projects from a lateral side edge 134C of slider plate 134. In the embodiment of FIG. 15, tenon member 137 is T-shape and defines an enlarged leading square head 137A coplanar to slide plate 134 and adapted to face the fastener ejection end section 70 of magazine 56. An arcuate seat 220 is formed edgewisely of flange 136 opposite slider plate 134 and in generally facing register therewith. Arcuate seat 220 is adapted to partly surround the recoil band casing 76, and seat 220 and associated flange 136 retain casing 76 in position. Flange 136 extends through a slit 82 (FIG. 34) made through the body of magazine 56, to enable transverse slider plate 134 to reach and engage slider guide tracks 60, 60'.

Preferably, the head 137A of tenon member 137 is tapered, and thus defines a chamfered leading edge 137B. A fastener pusher member 150 is provided, consisting of a pair of sensors 152, 152' and another pair of keys 153, 153', which when joined together are sized and shaped to slidingly fit into guide tracks 60, 60', between the two side legs of the stack of U-shape staples 64, within the fastener support rail 58. In one embodiment, sensors 152, 152', are similar to one another and of generally rectangular shape, and each defines:

a) a flat rectangular main body 154 having a transverse groove 156 on the interior face 154A of one end portion thereof; the width of each rectangular main body 154 will be smaller than the width of fastener support rail 58.

b) a pair of arcuate cavities 158, 160, open up from the exterior face 154B of the two opposite corners at the end portion thereof opposite groove 156.

c) a T-shape extension tab 162 extends from main body 154 in between cavities 158, 160, coplanar to main body 154; tab 162 includes a pair of opposite teeth 164, 166, projecting transversely from the plane of main body 154 slightly through the plane of main body opposite interior face 154A.

d) a pair of out-turned jaws 184A, 184B, (184K, 184B') are formed at the end of sensors 152, 152', opposite arcuate cavities 158, 160.

In one embodiment, keys 153, 153' are similar to one another, each slightly more than half the size of one of elements 152 or 152', and each of generally L-shape. Each L-shape element 154, 154' defines:

a) an elongated leg 170 (170') forming a cross in cross-section, with a transverse opposite semi-circular fingers 174, 174', being defined, each semi-circular finger 174, 174', being sized and shaped to snugly but releasably fit inside a corresponding arcuate cavity 158, 160 of sensor 152,152'; and b) a transverse end leg 178, 178', projecting from opposite fingers 174, 174' in the same direction thereof. Each leg 178, 178', defines a leading edge with teeth 178A, 178A'.

Figure 6:
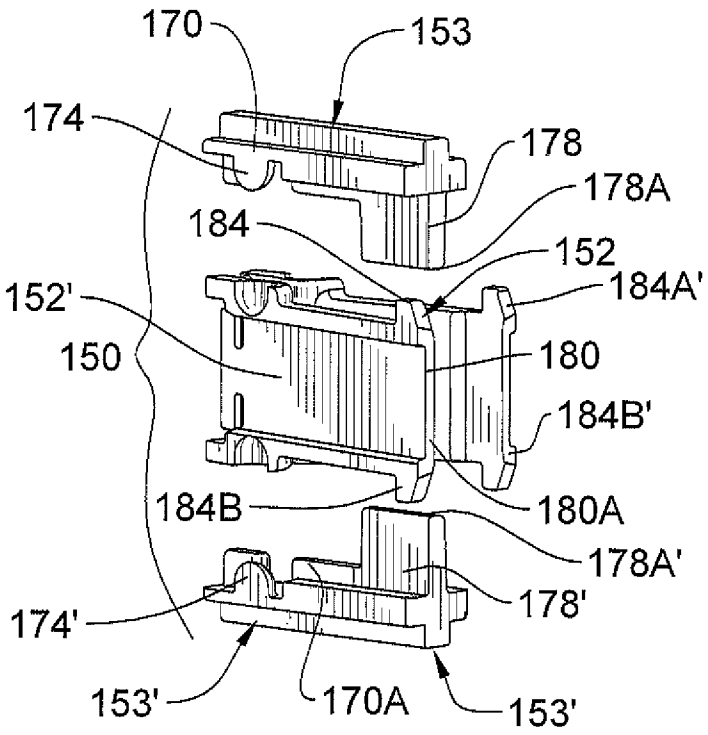
FIG. 6 is an enlarged exploded perspective view of the pair of sensors and pair of keys illustrated in FIG. 5 and forming part of the fastener feeder assembly, suggesting the "click-on" releasable interlocking mating thereof.

As suggested in FIG. 6, keys 153, 153', are releasably edgewisely interengaged with sensors 152, 152' by engaging complementary fingers 174, 174', into complementary shape cavities 158, 160, while transverse key legs 178, 178' are sized to thereafter edgewisely abut with one another in a coplanar fashion parallel to the main bodies of rectangular planar sensor elements 152, 152', and with teeth 164, 166 facing one another. Thus joined, elements 152, 152', 153, 153' form a free standing quadrangular box unit 150 defining an inner pocket or enclosure 180 accessible at one end by an access mouth 180A located opposite cavities 158, 160. Such joined elements 152, 153, 152', 153', form a fastener pusher 150, and are loosely freely connected to one another, but upon pusher member 150 edgewisely engaging magazine guide tracks 60, 60", such joined elements 152, 152' 154, 154' become frictionally interlocked with one another and remain so during sliding travel along slider tracks 60, 60'. However, sensor elements 152, 152' will be allowed to pivotally tilt slightly about the hinge formed by fingers 174, 174' and cavities 158, 160, outwardly away from the plane of the two magazine slider tracks 60, 62, upon the recoil system 68 being manually pulled by an operator to allow mouth 180A between jaws 184A, 184B, 184A', 184B', to spread open since these sensor jaws have been released by the U-shape staples.

Tenon member 137 will be sized and shaped to be able to engage through another end mouth 180B of sensors and keys enclosure 180, opposite mouth 180A and circumscribed by teeth 164, 166, with tenon head 137A engaging into enclosure 180 through mouth 180B and kept remaining trapped therein by the two pairs of teeth 164, 166.

Accordingly jaws 184A/B/A'/B' of sensors 152, 152' form fastener pushers for corresponding side U--legs of the staples 64, key 153, 153' form skate elements, and tenon 137 becomes sandwiched therebetween through mouth 180B between the trailing end portion of sensors 152, 152' into sensors and keys enclosure 180, and drive forward sensors 152, 152' and associated keys 153, 153', It is thus understood from FIG. 5 that the following steps are followed:

a) slider 134 is engaged through guide tracks 60, 60', and brought toward spring loaded recoil unit 68 and armed under spring load from recoil unit 68;

b) sensors 152, 152' and keys 153, 153', are brought together to mate in freely releasable interlocking fashion, to form a unitary box-like pusher member 150;

c) unitary box pusher unit 150 engages into magazine guide tracks grooves 60, 60', along arrow J of FIG. 5, between the side legs of U-staples 64, carried by fastener support rail 58, to be frictionally engaged by tenon 137 of slider 78 in releasably interlocking fashion; and d) a guide plate gate 280 is anchored against the fastener drive end of magazine 56 with through bolts 282 to keep slider 134 and pusher member 150 in place inside tracks 60, 60'.

It can now be understood that in present invention, an outwardly expandible fastener pusher member is provided, having a trigger which may be of the dual type. This will allow gravity fed fasteners 62 moving through the fastener support rail, however when all fasteners come to be ahead thereof (e.g. upstream) of the pusher member, the pusher member 150 automatically self-engages behind the trailing fastener from the stack of fasteners lodged in the magazine fastener support rail 58.

This invention enables reloading of the magazine 54 without other handling. The only thing required will be, after fasteners have been loaded within the magazine fastener support rail 58, to bring the pusher 150 back behind (downstream) the fasteners which will self-arm the pusher in its operative condition after release of the operator's hand. Handling is thus minimized and loading speed is increased, compared to prior art systems.

Figure 12:
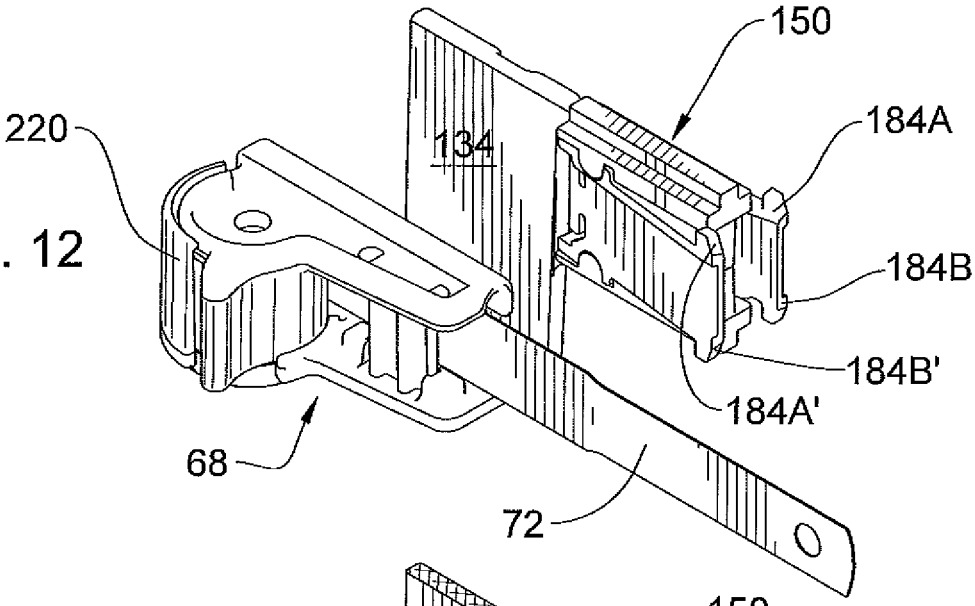
FIGS. 12-14 are perspective views of the recoil band system, keys, sensors and slider member from the feeder assembly of FIG. 5, sequentially suggesting the play of the two sensors, with FIGS. 12 and 13 showing the sensors leading jaws in a spaced apart staples pushing position, while FIG. 14 showing the sensors loading jaws brought toward one another in a loaded magazine feeder assembly being in standby condition.
Figure 13:
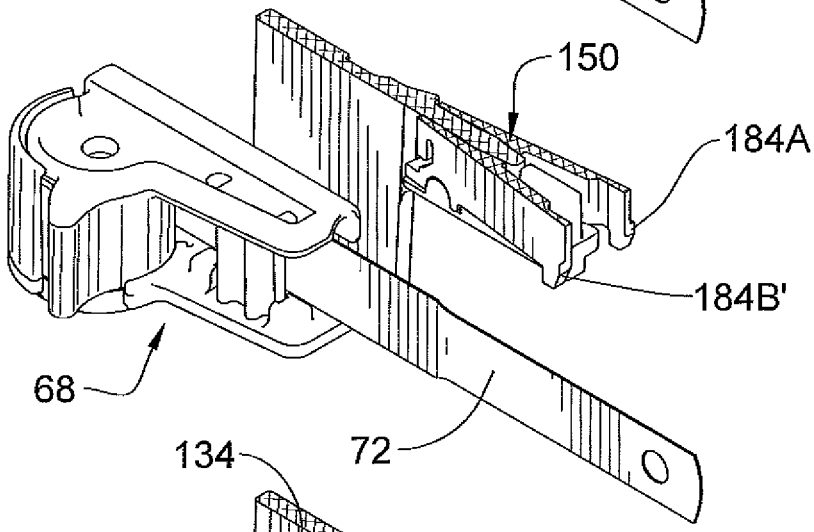
Figure 14:
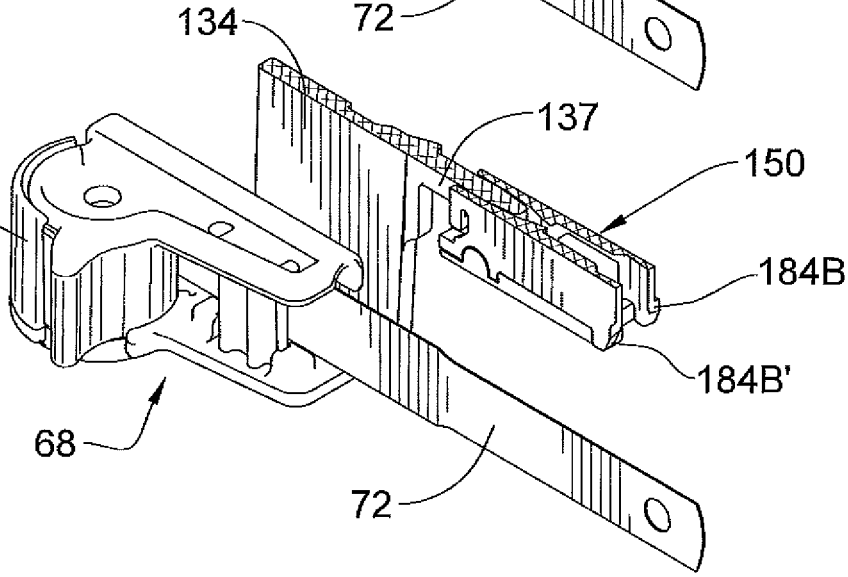
Figure 15A:
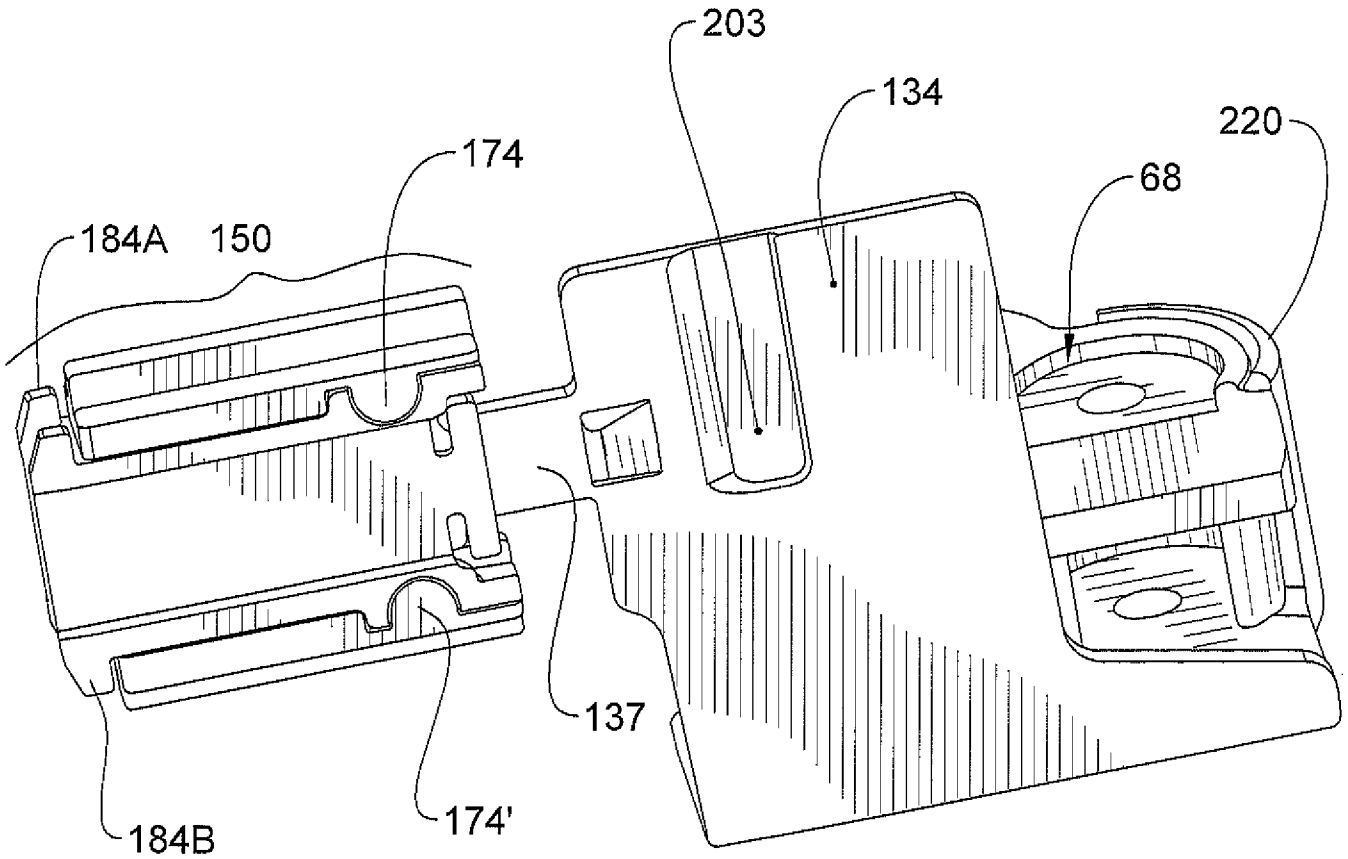
FIGS. 15A and 15B are views similar to FIG. 15 but at an enlarged scale and from different perspectives and further showing the fastener pusher member being engaged with the tenon member.
Figure 15B:
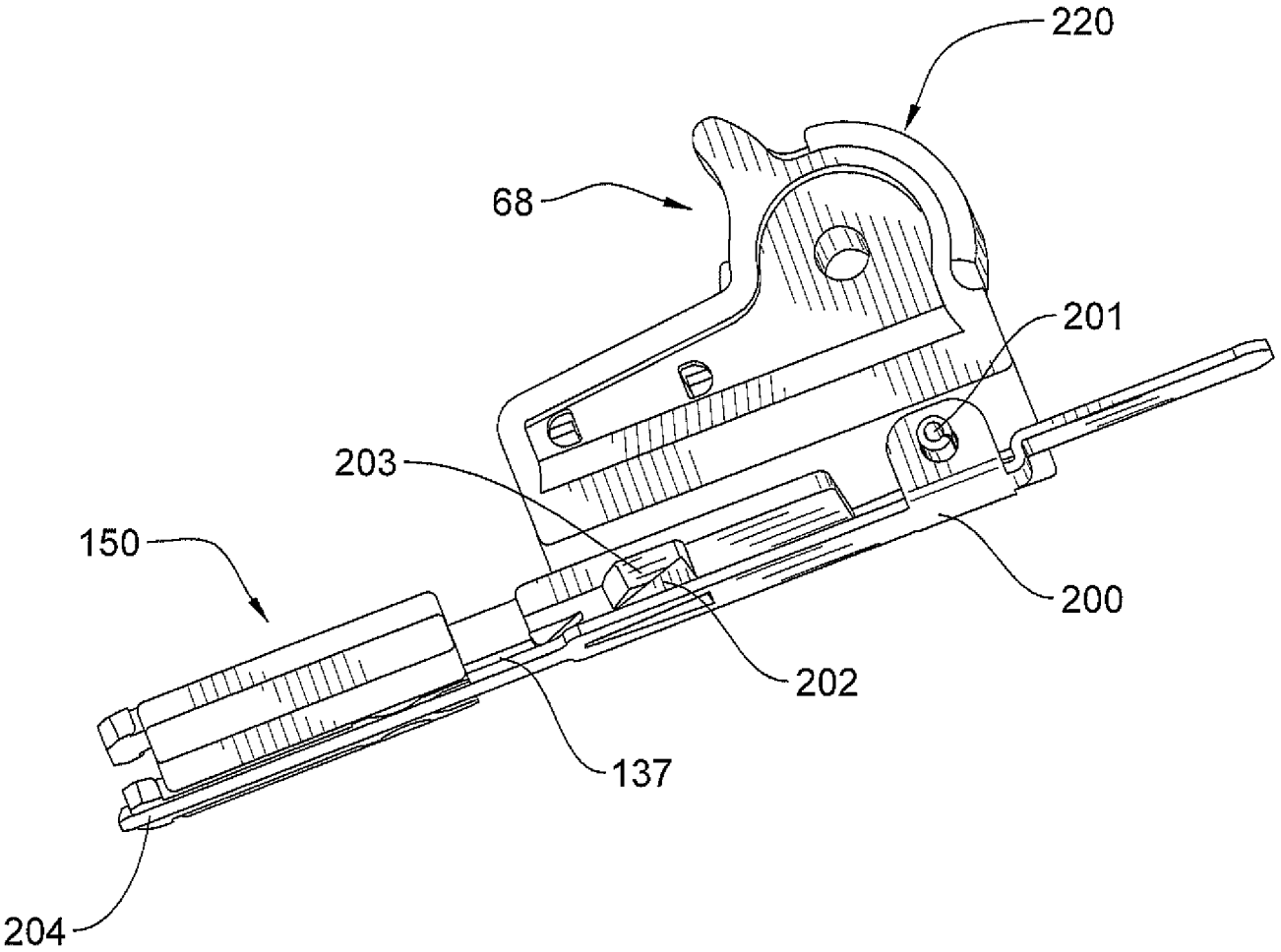

As sequentially suggested in FIGS. 12 to 14 of the drawings, the present pusher system 150 allows the release of the fasteners when the backward motion thereof is triggered. Upon release of the spring loaded force from recoil band unit 68, the extension of the pusher elements 150 is enabled, and thus there is a release of the push-release of the fasteners 62. This mechanical system will operate due to the static friction of the trailing teeth 164, 166 relative to the leading jaws 184A/B/A'/B'.

In one embodiment, the present invention is mounted to a stand-alone magazine 54; in another embodiment, to a magazine operatively connected to a fastener. In the embodiment of magazine of FIG. 1, the plate against the magazine front end covers the magazine fastener support rails 58, and has an aperture sized complementarily to the U-shape of the staples, to enable the latter to freely pass therethrough. This aperture is symmetrical in the case of a staples magazine. In the elbowed magazine embodiment of FIG. 1, the fastener magazine capacity can be tripled accordingly.

Figure 35:
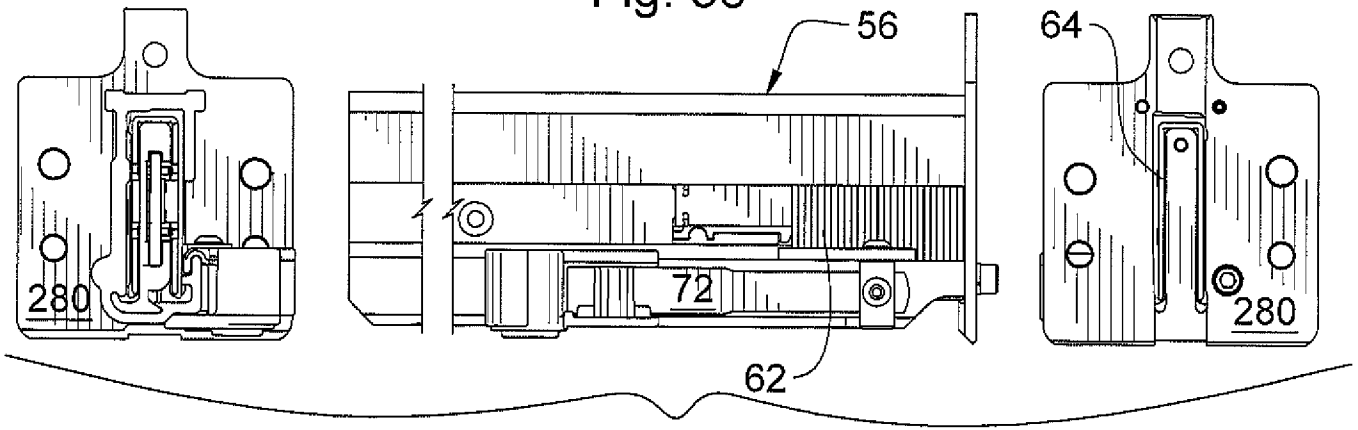

Alternately, in a 2-in-1 magazine, illustrated in FIGS. 35 and 36, which allows both straight nails and U-shape staples feeding, the aperture will be larger on the open side of the extrusion to allow free passage of the single leg nail, since a nail is usually larger than a staple.

Another direct advantage of the present self-arming fastener pusher system is the possibility to add a controlled action system, by adding a locking element which will automatically detect the minimal number of fasteners inside the magazine to allow triggering of the feeder assembly system at the selected time. For this system to operate, it is understood that the fasteners must be allowed to pass through the hollow of the enclosure 180 of the fastener box-like pusher member 150, which explains why there is provided a de-clutchable slider. It is thus possible to add a slider to the elbowed magazine, since the slider always remain in the downstream section of the magazine. This allows the doubling of the fastener loading capacity in the pneumatic nailer magazine.

In an alternate self-arming embodiment, the present pusher member may be used with nails. A combo 2-in-1 (nail and U-staples) magazine is therefore not excluded from the scope of the present invention, for example as disclosed in applicant's co-pending Canadian industrial design application No 156 061 filed Apr. 8, 2014, (being incorporated herewith by way of reference), with self-arming double clutching system automatically engaging when the number of fasteners becomes low. In a 2-in-1 fastener magazine, the staples may be loaded at the top thereof and the nails at the rear thereof. In an alternate embodiment, the two different fasteners, i.e. nails and staples, are loaded at the same rear location thereof; in such a magazine, an open extrusion is made on an exposed wall thereof.

In FIG. 16, a stopper seat 300 is made integral to sensor 152 adjacent mouth 180A. The magazine external extrusion has been removed for clarity of the view and to expose internal components. The stopper seat 300 projects outwardly from the sensor plane thereof so that seat 300 constitutes an abutment against which the fasteners (nail or staples) will come to bear, thus preventing them from reaching the guide plate gate 280. The two pushers sensors 152, 152', are usually opened, and thus the stoppers 300 are in the way of the fasteners when the pusher member assembly is armed by rearwardly pulling action of recoil band means 68, the two sensors 152, 152' will then become generally parallel to one another, thus releasing the fasteners, because mouth 180A will close by drawing jaws 184A/B/A'/B' toward one another.

Figures 17, 18, 19:
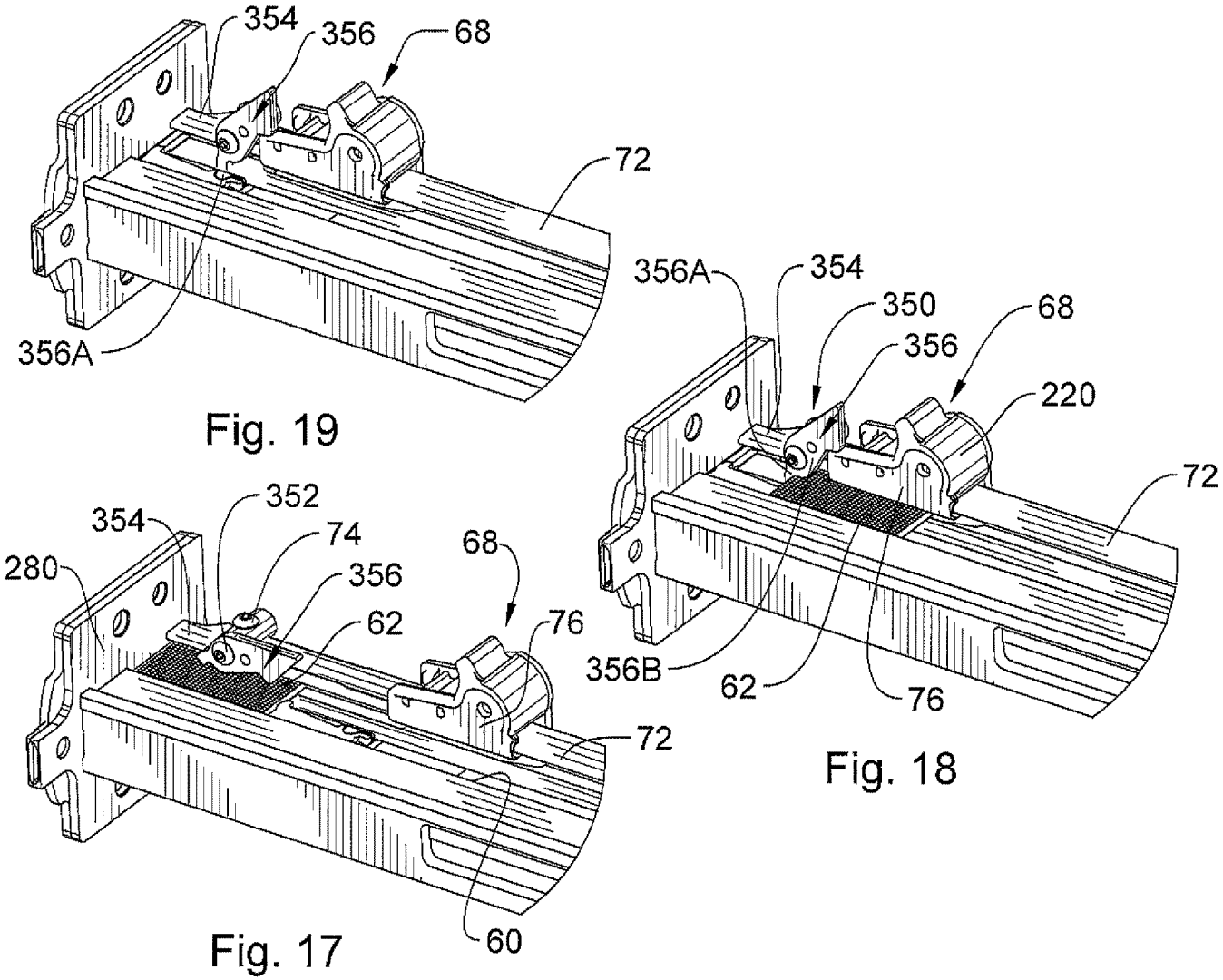
FIGS. 17 to 19 show perspective views of an alternate embodiment of the elements of FIG. 16 but a smaller scale and sequentially suggesting how the feeder assembly operates, showing a toggle lever system that prevents accidental fastener jamming during magazine fastener loading.
Figure 20:
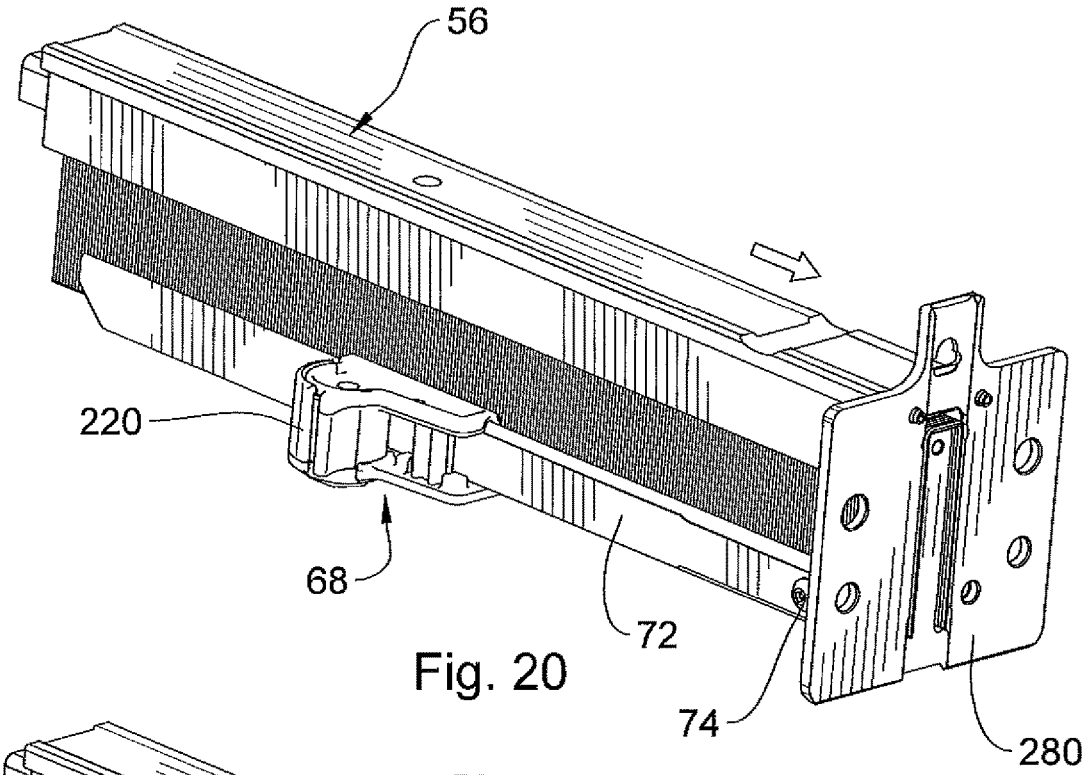
FIGS. 20 and 21 show perspective views of the staples magazine and associated feeder assembly, with magazine full U-shape staples load and slider in standby position, and with the magazine partial U-shape staples load slider in operative engaged condition and stack of U-staples being pushed, respectively.
Figure 21:
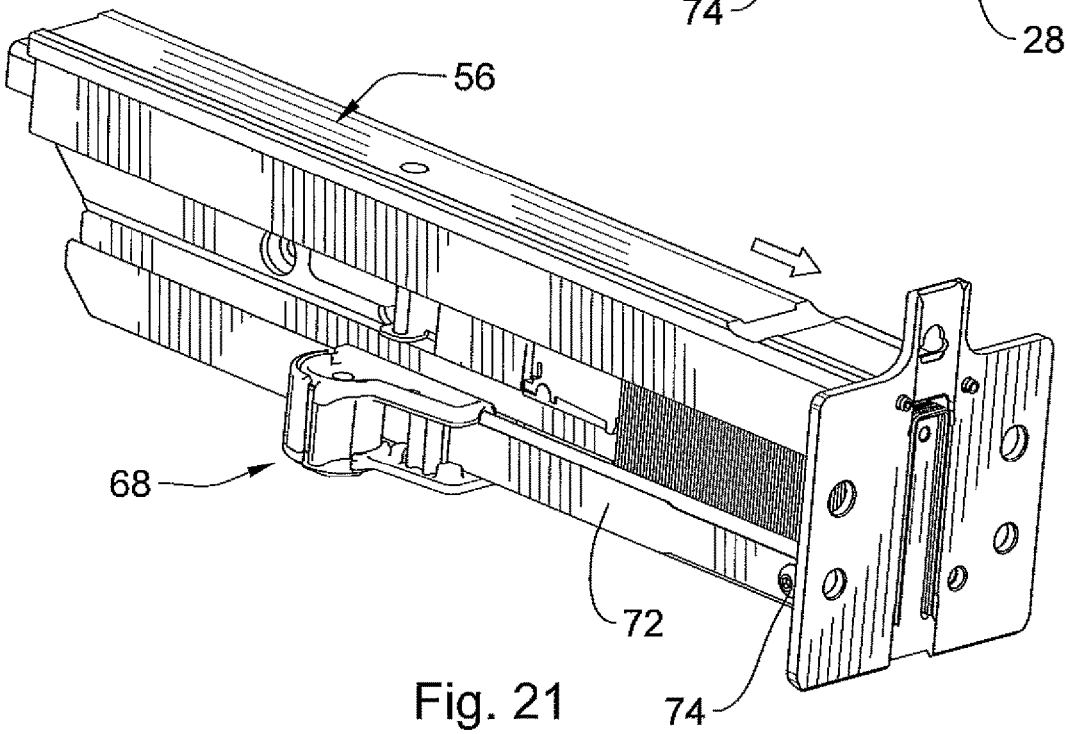
Figure 22:
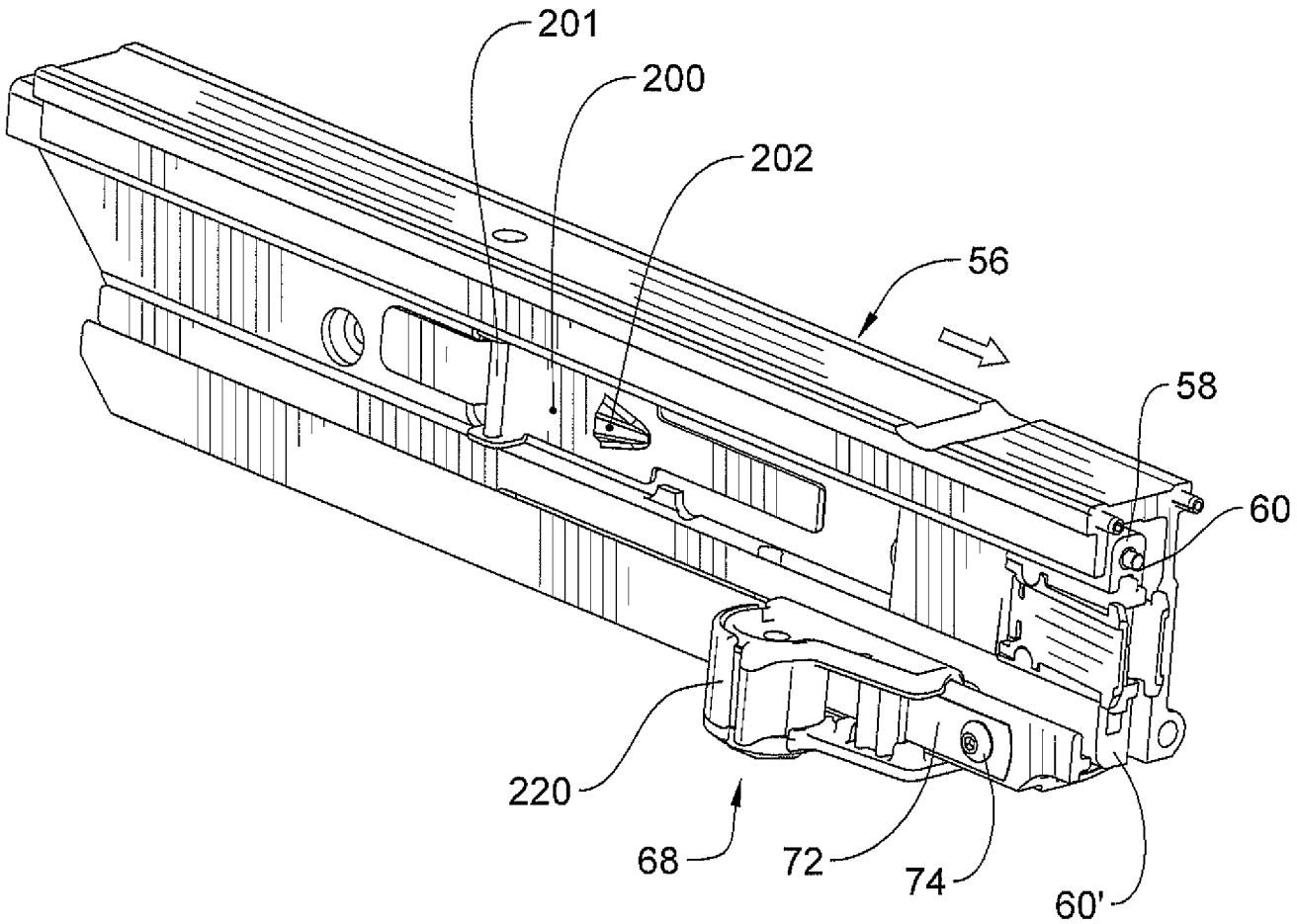
FIG. 22 shows a view similar to FIGS. 20-21 but with the magazine emptied of staples, and suggesting that the staples may overlap the pusher system mechanism, to reduce bulk of the whole pneumatic nailer tool and with the magazine side wall partly broken for clarity of the view to show the elongated tab.
Figure 23:
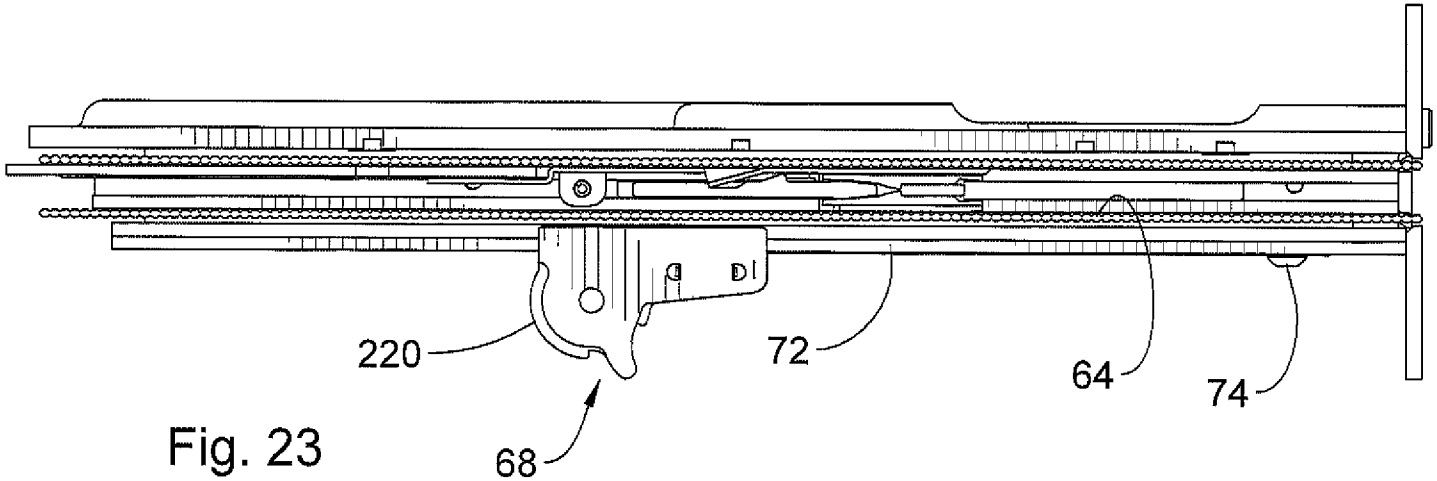

In the alternate embodiment of FIGS. 17-19, stopper seat 300 of FIG. 16 is replaced by a pivotal arm spacer system 350 mounted to rivet 74 about a pivot mount 352 transverse to the axis of rivet 74. Pivot arm spacer system 350 includes a trailing end stationary arm 354 extending parallel to guide track 60 and abutting against end gate plate 280, and a leading end toggle lever 356. Toggle lever 356 is movable between a first position, illustrated in FIG. 17 when lever 356 extends generally parallel to fastener guide track 60 in overhanging fashion above a stack of fasteners 62, and a second position illustrated in FIGS. 18 and 19, wherein toggle lever 356 is transverse to stationary lever 354. As suggested in FIG. 18, toggle lever 356 includes a trailing hook 356A adapted to hookingly retainingly engage with the trailing edge of the stack of fasteners 62, and a leading edge notch 356B adapted to abut against the trailing end of recoil band casing 76 responsively to stack of fasteners travel.

When the slider of the present invention is mounted to a magazine of the type disclosed in applicant's U.S. Pat. No. 8,292,144, (also incorporated herewith by way of reference) the fasteners loading is again simpler. This will allow reloading at any time, without any other handling, and without having to load the magazine beyond its capacity level which otherwise would have required an additional unloading operation.

Figure 24:
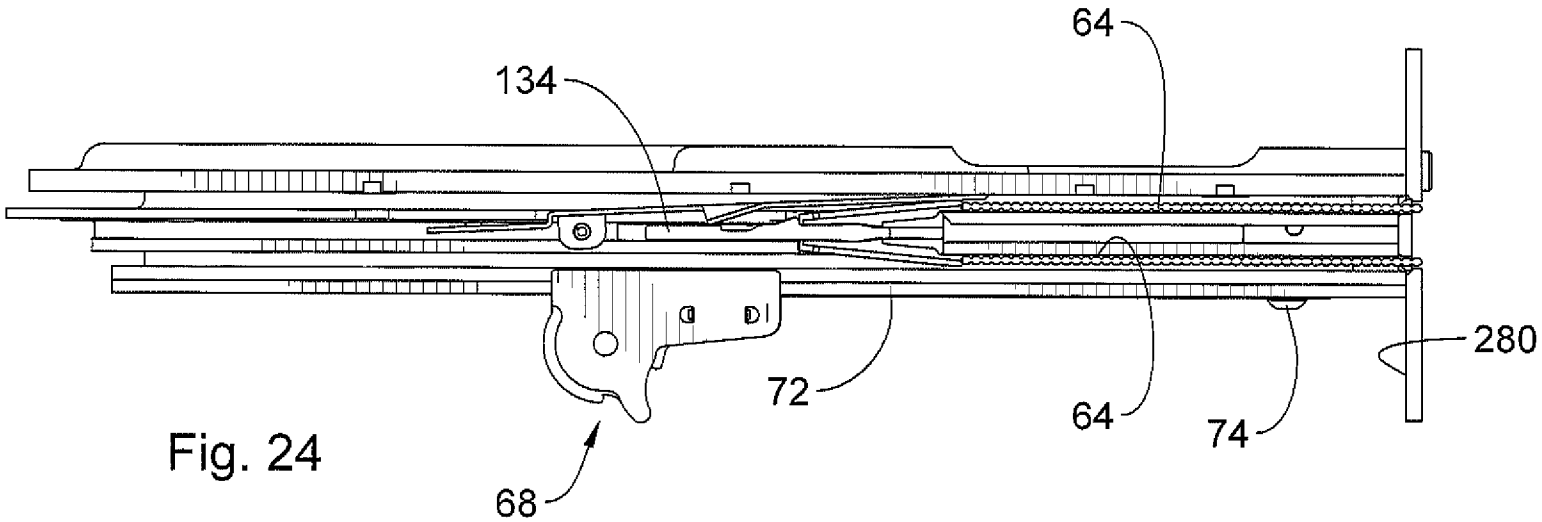
FIGS. 23 and 24 are longitudinal sectional views of the elements of FIGS. 20 and 21 respectively in operative and inoperative modes respectively of the fastener retention device.
Figure 24A:
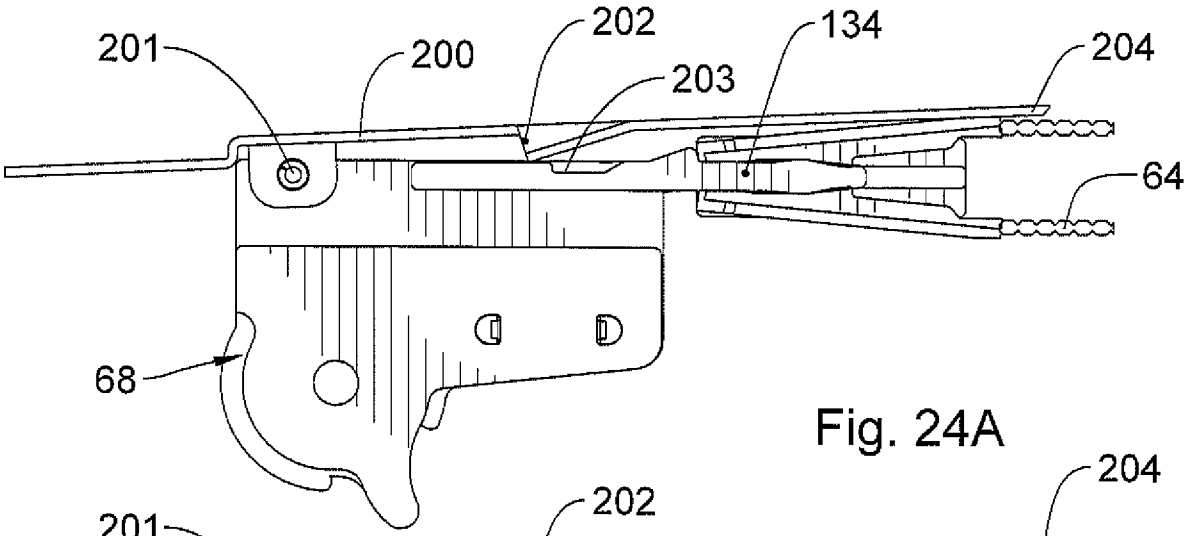
FIGS. 23A and 24A are enlarged views of the central section of FIGS. 23 and 24 respectively.
Figure 23A:
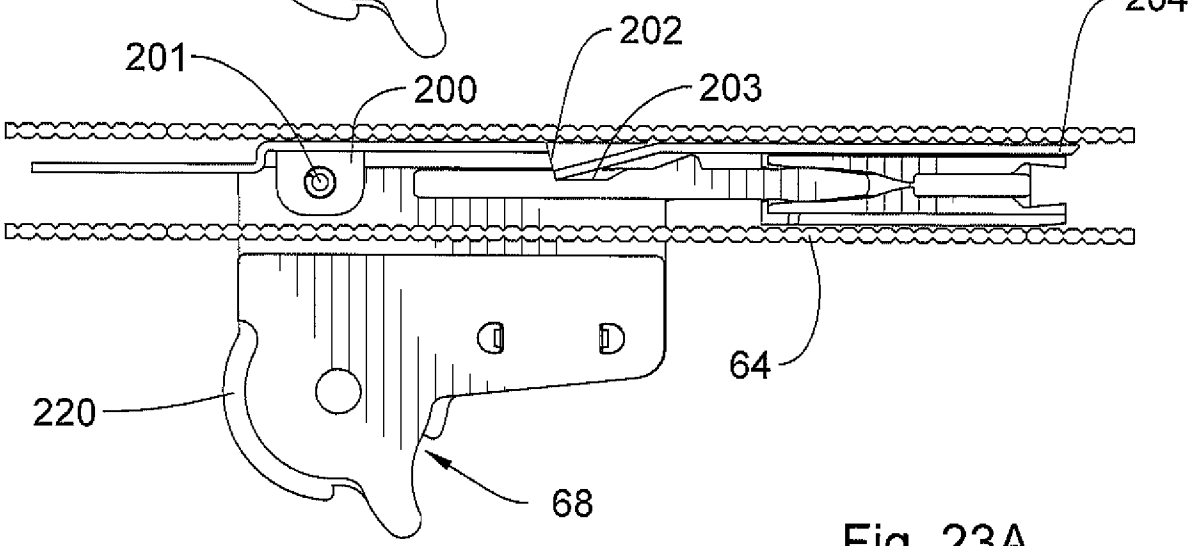
Figure 26:
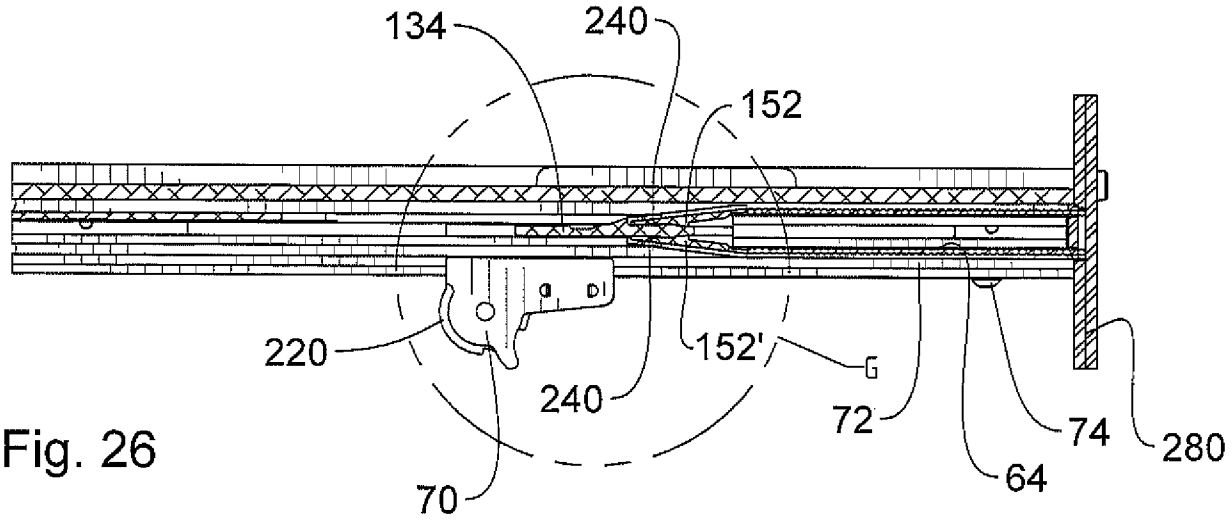
FIG. 26 is a longitudinal sectional view taken along line C-C of FIG. 25.

A fastener retention device may be provide to the fastener pusher, defining an operative mode active with a large storage load of fasteners into the magazine, and a inoperative mode triggered when the load of magazine feeders decreases below a threshold value. As best illustrated in FIGS. 15A, 15B, 22, 23A and 24A, an elongated tab 200 (see U.S. Pat. No. 8,292,144) is pivotally carried at pivot mount 201 to an intermediate section of the side wall of magazine 56. As shown in FIG. 24A, in the inoperative mode of the fastener retention device, the loading end edge 204 of tab 200 is forced to withdraw between the two lateral side legs of the U-shape staples 64. The intermediate transverse projecting ear 202 of tab 200 is biased to engage into cavity 203, thus preventing forward motion of the pusher assembly. However, when the load of staples decreases to a certain level, the leading end 204 of tab 200 is released, followed by ear 202. The pusher assembly is then released, jaws 184A, 184B/A'/B' open and come to abut against the side legs of U-shape staples 64.

Accordingly, in the present invention, the U-shape staples loading steps are simplified, as follows:

1. instead of the prior art standard OPEN/LOAD/CLOSE sequence routine for U-shape staples loading in pneumatic nailers, we now have a simpler LOAD/ARM sequence routine;

2. the self-arming feature of the pusher member enables loading into the fastener magazine of a larger number of fasteners, compared to the prior art magazine;

3. the self-arming pusher member enables rearward loading, which is more user-friendly than top-end loading; and 4. the self-arming pusher member provides means to avoid accidental fastener jamming upon gravity feed.

With the present invention, it is expected that pneumatic fastener operator's productivity will be enhanced by at least 10% because of less time required for periodic fastener reloads inside the magazine; moreover, ergonomic comfort of the operator will also be enhanced.

Staples loading in the magazine is a simpler two step operation, compared to prior art three loading step operations. Control of the lateral play of the pusher member 150 is enabled by free-standing, including cam free and shaft/bolt free attachment means of four complementarily sized and shaped interlocking sensors and keys elements, combined with the slider tenon member. Moreover, the present invention discloses an ingenious way of controlling the play of the two pusher sensors simultaneously and in a coordinated way.

We claim:

1. A self-arming staples feeder system in a fastener driving device for feeding U-shape staples from a fastener support rail formed in a magazine to a fastener drive track formed in a drive guide for reciprocating movement of a driver and connected to a forward portion of the fastener guide track, the U-shape staples defining two side legs and a base leg, said feeder system comprising:

a slider member operable by an operator and slidably movable in a facing guide tracks slider channel made in a longitudinal direction of the fastener support rail;

biasing means for biasing said slider member in the forward direction of the fastener support rail slider channel;

a pusher member movably mounted in said slider channel in the longitudinal direction of the fastener support rail and defining a pair of opposite sensors, each of said sensors having opposite first and second end portions, a pair of spaced jaws formed at said sensors first end portions and sized and shaped for abutting against the staples side legs respectively at a trailing end of a stack of staples on said support rail, said jaws defining a gap therebetween, and free standing hinge means provided at said sensors second end portions for tilting said sensors relative to one another wherein said jaws are movable relative to one another responsive to staples travel between an open position in register with the staples two side legs, and a retracted position clearing the trailing end of the stack of staples wherein the pusher member is sized and shaped to freely engage within said slider channel and between the two side legs of the U-shape staples carried by the support rail in said jaws open position in concealed fashion; and interlocking means provided between said slider member and said pusher member for permitting movement of said pusher member concurrently with said slider member within said slider channel and for moving said pusher member in such a manner that said jaws move from said open position to said retracted position according to movement of said slider member in a rearward direction of the fastener support rail.

2. A staples feeder system as in claim 1, wherein said hinge means comprises a pair of keys, for slidingly engaging said slider channel and edgewisely freely mounted to said sensors intermediate said first and second end portions thereof, each of said keys having a transverse ear and each of said sensors second end portions having a transverse cavity of complementary shape to that of a corresponding key ear, said keys ears releasably engaging with corresponding said sensors cavities, each said sensor being planar, wherein an enclosure is formed between said planar sensors and circumscribed by said keys.

3. A staples feeder system as in claim 2, wherein said interlocking means comprises a tenon member, integrally carried by said slider member, a mortise section being formed within said sensors and keys enclosure including a second mouth at said sensors second end portions and of shape complementary to that of said tenon member, said second mouth releasably engaged by said tenon member.

4. A staples feeder system as in claim 3, wherein each of said pusher member keys further includes a guide finger, opposite corresponding said cavities, the two guide fingers extending into said sensors and keys enclosure adjacent said jaws thereof.

5. In combination, a pneumatic nailer two in one magazine and a nails and two step self-arming loading staples feeder system in a fastener driving device for feeding nails and U-shape staples from a fastener support rail formed in said magazine to a fastener drive track formed in a drive guide for reciprocating movement of a driver and connected to a forward portion of the fastener guide track, the U-shape staples defining two side legs and a base leg, said feeder system comprising:

a slider member operable by an operator and slidably movably mounted in a facing guide tracks slider channel made in the longitudinal direction of the fastener support rail slider channel;

biasing means biasing said slider member in the forward direction of the fastener support rail;

a pusher member movably mounted in said slider channel in the longitudinal direction of the fastener support rail and defining a pair of opposite planar sensors, each of said sensors having opposite first and second end portions, a pair of spaced jaws formed at said sensors first end portions and sized and shaped for abutting against the staples two side legs respectively at a trailing end of a stack of staples on said support rail, said jaws defining a gap therebetween, and free standing hinge means provided at said sensors second end portions for tilting said sensors relative to one another responsive to staples travel wherein said jaws are movable relative to one another between an open position in register with the two side legs of the staples, and a retracted position clearing the trailing end of the stack of staples wherein the pusher member is sized and shaped to freely engage within said slider channel and between the two side legs of the U-shape staples carried by the support rail in said jaws open position and be concealed by same; and interlocking means provided between said slider member and said pusher member for permitting movement of said pusher member concurrently with said slider member within said slider channel and for moving said pusher member in such a manner that said jaws move from said open position to said retracted position according to movement of said slider member in a rearward direction of the fastener support rail.

6. The combination of claim 5, wherein said hinge means comprises a pair of keys, slidingly engaging said slider channel and edgewisely freely mounted to said sensors intermediate said first and second end portions thereof, each of said keys having a transverse ear and each of said sensors second end portions having a transverse cavity of complementary shape to that of a corresponding key ear, said keys ears releasably engaging with corresponding said sensors cavities, wherein an enclosure is formed between said planar sensors and is circumscribed by said keys.

7. A combination as in claim 6, wherein said interlocking means comprises a tenon member, integrally carried by said slider member, a mouth being formed within said sensors and keys enclosure at said sensors second end portions and of shape complementary to that of said tenon member, said mouth releasably engaged by said tenon member.

8. A combination as in claim 7, wherein each of said pusher member keys further includes a guide finger, opposite corresponding said cavities, these two guide fingers extending within said sensors and keys enclosure adjacent said jaws thereof.

9. A combination as in claim 5, further including a staples jamming mitigating means, substantially reducing the likelihood of staples jamming inside the magazine fastener support rail when the number of staples remaining said fastener support rail is reduced to only a few.

10. A combination as in claim 9, wherein said staples jamming mitigating means consists of a toggle lever means cooperating with said biasing means and responsive to travel of the staples in preventing said slider member to extend beyond a threshold area of said fastener support rail closely spacedly proximate said fastener support rail.

11. A combination as in claim 9, wherein said staples jamming mitigating means consists of a sensor seat, projecting outwardly from the plane of one of said planar sensor and providing transverse abutment surface in the way of travel of staples and preventing said staples to extend beyond a threshold area of said fastener support rail closely spacedly proximate said fastener support rail.

12. In combination, a pneumatic nailer magazine and a controlled action two step self-arming loading staples feeder system in a fastener driving device for feeding nails and U-shape staples from a fastener support rail formed in said magazine to a fastener drive track formed in a drive guide for reciprocating movement of a driver and connected to a forward portion of the fastener guide track, the U-shape staples defining two side legs and a base leg, said feeder system comprising:

a slider member operable by an operator and slidably movably mounted in a facing guide tracks slider channel made in the longitudinal direction of the fastener support rail slider channel;

biasing means biasing said slider member in the forward direction of the fastener support rail;

a pusher member movably mounted in said slider channel in the longitudinal direction of the fastener support rail and defining a pair of opposite planar sensors, each of said sensors having opposite first and second end portions, a pair of spaced jaws formed at said sensors first end portions and sized and shaped for abutting against the staples two side legs respectively at a trailing end of a stack of staples on said support rail, said jaws defining a gap therebetween, and free standing hinge means provided at said sensors second end portions for tilting said sensors relative to one another responsive to staples travel wherein said jaws are movable relative to one another between an open position in register with the two side legs of the staples, and a retracted position clearing the trailing end of the stack of staples wherein the pusher member is sized and shaped to freely engage within said slider channel and between the two side legs of the U-shape staples carried by the support rail in said jaws open position and be concealed by same;

interlocking means provided between said slider member and said pusher member for permitting movement of said pusher member concurrently with said slider member within said slider channel and for moving said pusher member in such a manner that said jaws move from said open position to said retracted position according to movement of said slider member in a rearward direction of the fastener support rail;

said nails and staples movable under gravity forces through said fastener support rail from a fastener intake means thereof to a fastener discharge means thereof opposite said fastener intake means; and a pusher means retention means, said retention means having an operative mode, active with a large storage load of fasteners into said channel member, and an inoperative mode, triggered when said load of fasteners in said channel member decreases below a threshold value.

13. The controlled action feeder magazine assembly as in claim 12, wherein said fastener pusher member includes a carriage slidably carried into said channel with said carriage including a notch and said retention means including an elongated rigid lock tab endwisely pivotally mounted at an intermediate first pivot mount to said channel at said fastener intake means, wherein one and another tab end portions are defined on opposite sides of said first pivot mount, said another tab end portion including an intermediate transversely projecting ear releasably engaged into said notch in said fastener pusher means operative mode; and said ear disengaged from said notch in said fastener pusher means inoperative mode, said inoperative mode being induced by fastener depletion-based tilt release of said another tab end portion about said first pivot mount.

14. The controlled action feeder magazine assembly as in claim 12, wherein said fastener pusher member includes a carriage slidably carried into said channel and having a transverse leg, and said retention means includes an ear integrally projecting from opposite side walls defined by said channel therewithin, said ear releasably abutting against said transverse leg in said operative mode of said retention means, and said ear disengaging said carriage transverse leg in said inoperative mode thereof, said inoperative mode being induced by fastener depletion-based release of said transverse leg from said ear.

15. The controlled action feeder magazine assembly as in claim 12, wherein said pneumatic nailer magazine is a two in one magazine, and wherein said feeder system is a controlled action nails and two step self-arming loading staples feeder system.

* * * * *